US009932792B2

(12) United States Patent
Younger et al.

(10) Patent No.: US 9,932,792 B2
(45) Date of Patent: Apr. 3, 2018

(54) TOOL

(71) Applicant: SHELL OIL COMPANY, Houston, TX (US)

(72) Inventors: Rae Andrew Younger, Ellon (GB); Simon McKay, Aberdeen (GB); James George Oag, Aberdeen (GB)

(73) Assignee: SHELL OIL COMPANY, Houston, TX (US)

( * ) Notice: Subject to any disclaimer, the term of this patent is extended or adjusted under 35 U.S.C. 154(b) by 0 days.

(21) Appl. No.: 15/037,247

(22) PCT Filed: Nov. 18, 2014

(86) PCT No.: PCT/GB2014/053399

§ 371 (c)(1),
(2) Date: May 17, 2016

(87) PCT Pub. No.: WO2015/075429

PCT Pub. Date: May 28, 2015

(65) Prior Publication Data

US 2016/0290082 A1 Oct. 6, 2016

(30) Foreign Application Priority Data

Nov. 19, 2013 (GB) ..... 1320429.2
Dec. 3, 2013 (GB) ..... 1321299.8

(51) Int. Cl.

| | |
|---|---|
| ***E21B 29/02*** | (2006.01) |
| ***E21B 29/12*** | (2006.01) |
| ***E21B 17/10*** | (2006.01) |
| ***E21B 43/117*** | (2006.01) |
| ***E21B 43/1185*** | (2006.01) |

(52) U.S. Cl.
CPC ..... *E21B 29/02* (2013.01); *E21B 17/10* (2013.01); *E21B 43/117* (2013.01); *E21B 43/1185* (2013.01)

(58) Field of Classification Search
CPC ..... E21B 17/10; E21B 29/02; E21B 29/12; E21B 43/117; E21B 43/1185
See application file for complete search history.

(56) References Cited

U.S. PATENT DOCUMENTS 3,016,014 A * 1/1962 Lebourg ..... E21B 43/118 102/310
3,053,182 A * 9/1962 Christopher ..... B26F 3/04 102/307
3,089,417 A * 5/1963 Beyer ..... B26F 3/04 102/307

(Continued)

FOREIGN PATENT DOCUMENTS

WO 2007049026 5/2007
WO WO2013033306 3/2013

*Primary Examiner* — Matthew R Buck

(57) ABSTRACT

A severance tool for severing a target is described. The severance tool comprises a housing, a plurality of focused energetics, each focused energetic adapted to release energy in a preferred direction and a trigger mechanism adapted to detonate the focused energetics. The focused energetics are aligned such that, on impact with a target comprising a material, the energy released by one of said focused energetics cooperates with the energy released by another of said focused energetics to establish a separating force within the target material.

15 Claims, 23 Drawing Sheets

(56) References Cited

U.S. PATENT DOCUMENTS

| | | | | | |
|---|---|---|---|---|---|
| 3,146,711 | A * | 9/1964 | Schaadt | F42B 1/028 | 102/306 |
| 3,241,488 | A * | 3/1966 | Glass | E21B 43/117 | 102/310 |
| 3,336,759 | A * | 8/1967 | Cooper | E02B 17/00 | 166/297 |
| 4,191,265 | A * | 3/1980 | Bosse-Platiere | E21B 43/117 | 102/310 |
| 4,323,117 | A * | 4/1982 | Pierce | E21B 29/02 | 102/307 |
| 4,354,433 | A * | 10/1982 | Owen | B26F 3/04 | 102/307 |
| 4,619,556 | A * | 10/1986 | Parra | E02D 9/005 | 405/195.1 |
| 4,724,105 | A * | 2/1988 | Owen | B26F 3/04 | 102/307 |
| 6,131,517 | A * | 10/2000 | Poe | E02D 9/04 | 102/307 |
| 6,230,627 | B1 * | 5/2001 | Poe | E02D 9/04 | 102/307 |
| 7,779,760 | B2 * | 8/2010 | Konig | E21B 43/118 | 102/306 |
| 8,375,859 | B2 * | 2/2013 | Sagebiel | F42B 1/028 | 102/306 |
| 9,175,936 | B1 * | 11/2015 | Collier | F42B 1/032 | |
| 9,175,940 | B1 * | 11/2015 | Collier | F42B 1/032 | |
| 9,335,132 | B1 * | 5/2016 | Collier | | |
| 2005/0188878 | A1 * | 9/2005 | Baker | F42B 1/02 | 102/306 |
| 2013/0126153 | A1 * | 5/2013 | Baker | E21B 33/06 | 166/55 |

* cited by examiner

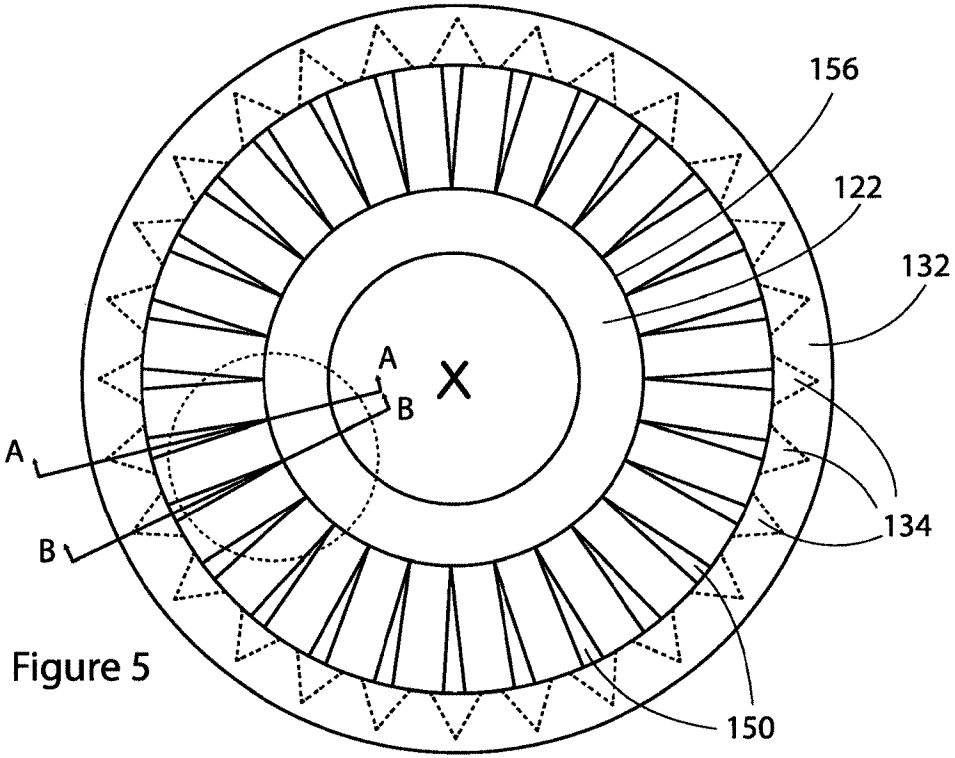
Figure 5
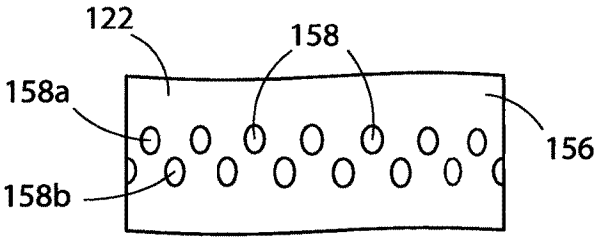
Figure 6
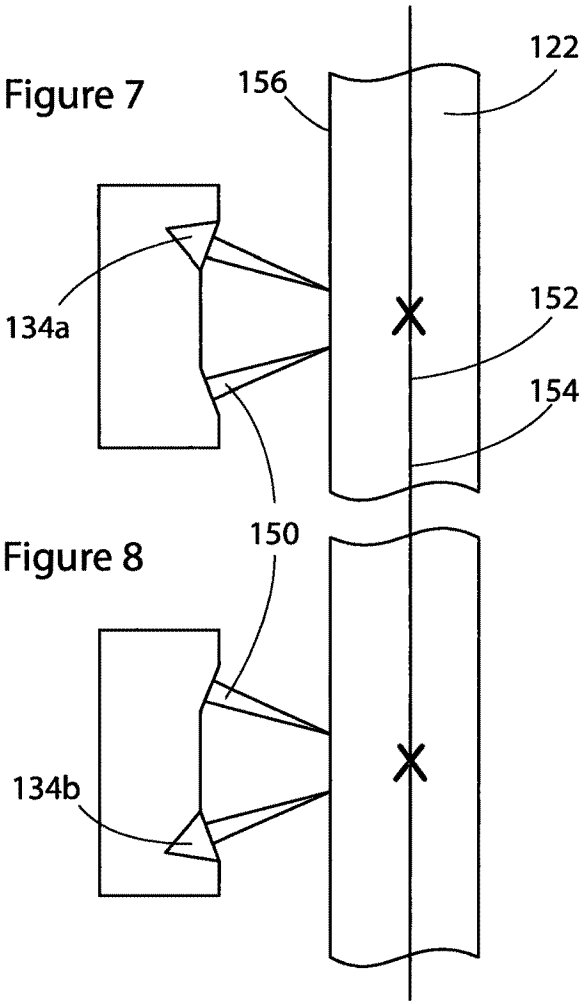
Figure 7
Figure 8

TOOL

FIELD OF INVENTION

The present invention relates to a tool for severing a target. Particularly, but not exclusively, the present invention relates to a tool for severing a tubular element.

BACKGROUND OF INVENTION

During hydrocarbon extraction operations, safety equipment is installed for utilisation in the event of catastrophic failure to prevent damage to human life and the environment. This is particularly the case for sub-sea hydrocarbon extraction where the presence of water can carry contamination from an oil well many thousands of miles potentially causing huge environmental damage.

The primary barrier utilised to shut a well is the blow out preventer which sits on the well head. For a subsea well, a riser links the oil rig to the blow out preventer, the riser allowing the passage of drilling and completion tools from the oil rig to the oil well through the blowout preventer. In the event of a catastrophe, it is beneficial to be able to sever drill pipe and the like within the riser to, first, permit successful detachment of the rig from the well head and, second, allow the severed tubular to drop below the closure mechanism of the blowout preventer, allowing the blow out preventer to close more easily.

The use of charges to sever tubulars has been previously described. These charges are generally in the form of a linear shaped charge which creates a blade of plasticised metal which is directed at the targets to be severed.

It has been found, however, that linear shaped charges, particularly when closing in on a tubular target, lose energy as they pass through the medium between the charge and the tubular element, and coalescence of adjacent charge material as the charge material converge on the target result in uneven impact on the target, with resulting non-uniform and inconsistent cutting. To overcome these problems, high amounts of explosives are required making the procedure more dangerous and costly than it otherwise would be.

Furthermore, where multiple shaped charges are used, there are detonation problems where the charges are in close proximity. Conventional detonation of multiple charges effectively happens sequentially and this can have an adverse effect on the cutting of the target to the extent that severance may not be achieved. The adverse effect may be caused by the jets of material coming together or impacting on the target at different times. Furthermore, non-simultaneous detonation by the trigger mechanism can result in the shockwave generated by one charge reaching and triggering an adjacent charge before the detonation signal has reached the adjacent charge.

SUMMARY OF THE INVENTION

According to a first aspect of the present invention there is provided a severance tool for severing a target, the severance tool comprising:

a housing;

a plurality of focused energetics, each focused energetic adapted to release energy in a preferred direction; and a trigger mechanism adapted to detonate the focused energetics;

wherein the focused energetics are aligned such that, on impact with a target comprising a material, the energy released by one of said focused energetics cooperates with the energy released by another of said focused energetics to establish a separating force within the target material.

In at least one embodiment of the present invention, aligning the focused energetics such that on impact with a target, the energy released by each of the focused energetics cooperate to establish a separating force in the target increases the utilisation of the energetic's energy.

Each energetic may be adapted to displace target material, in use, on impact with a target. By displacing rather than destroying target material, stresses can be established within the target material which can be utilised to aid separation of the target material.

Upon detonation, the energy released by each energetic may be in the form of a shockwave.

Additionally or alternatively, the energy released by each energetic may be in the form of a propelled object.

Particularly, at least some of the energetics may be shaped charges

The shaped charges may be linear shaped charges.

Alternatively, the shaped charges may be perforating charges. Firing perforating charges at the target has been found to be more effective than firing linear charges. Perforating charges are, as their name suggests, adapted to perforate the target and, when detonated, form a spear-like jet of material (formed from a charge liner) rather than a blade. The spear passing through the medium between the charge holder and the target more easily, allowing greater energy to be retained by the jet of material for cutting purposes.

Each shaped charge may comprise an explosive material and a charge liner. In this embodiment, upon detonation, the explosive material generates a shockwave which propels the charge liner, in a plasticised form, towards the target, the charge liner forming a jet of material.

In some embodiments, where the charge liner is a metal, the jet of material is a jet of plasticised metal.

The energy released by each focused energetic may be adapted to engage the target at a target location.

In some embodiments, the energy released by at least one focused energetic may be adapted to engage the target at a different target location to at least one other energetic.

In at least some embodiments, a first focused energetic is, in use, aligned such that the energy released by the first focused energetic engages the target at a first target location and a second focused energetic is, in use, aligned such that the energy released by a second focused energetic engages the target at a second target location.

In some embodiments, the first target location may be spaced away from the second target location.

The energy released by the first focused energetic may be adapted to create a first bore through a target external surface and the energy released by the second focused energetic may be adapted to create a second bore through the target external surface.

The first bore may be separated from the second bore by a bridge of material. Surprisingly it has been found that, to achieve separation of the tubular element, the energy released by the focused energetics does not need to impact the surface of the material such that the bores created overlap to create a slot effect. Rather it has been found that the energy generated by the detonation of the first shaped charge and the energy generated by the second shaped charge is transferred to the material and propagates through the bridge of material creating shear, compressive and tensile forces in the bridge of material which pull the molecular structure of the bridge of material apart, creating a continuous gap in the material from the bore created by the first focused energetic to the bore created by the second focused energetic.

In this embodiment, at least one shaped charge may be aligned such that the jet of material generated on detonation of said charge travels in a direction which is non-perpendicular to the target surface.

A plurality of shaped charges may be aligned such that the jets of material generated on detonation of the charges travel in a direction which is non-perpendicular to the target surface.

At least one focused energetic may be aligned such that the energy released upon detonation is directed, in use, at the target longitudinal axis.

Additionally or alternatively, where the target is a tubular element, at least one focused energetic may be aligned such that the energy released upon detonation is directed at a tangent to a target internal surface.

In some embodiments, at least one focused energetic is aligned such that the energy released upon detonation is directed at a trajectory such that the energy of, for example the shockwave, is dissipated whilst the shockwave is within the material from which the target is made.

In some embodiments, at least one focused energetic is aligned such that the energy released upon detonation is directed at a trajectory such that the energy of the jet of material is dissipated at or adjacent to the target internal surface.

In some embodiments, where the target is tubular, at least some of the focused energetics may be aligned such that the energy released by detonation of the/each focused energetic is directed at a tangent to the target internal surface. By directing the the energy released upon detonation tangentially to the target internal surface, the distance the jet of material travels through the target is maximised thereby maximising the damage caused by the energy of the jet of material.

The focused energetics may be aligned such that the energy released upon detonation of one focused energetic cooperates with the energy released upon detonation of another focused energetic to create separation forces within the target on impact. In one embodiment, the focused energetics are aligned such that the energy released upon detonation of the energetics impacts the target to create an axial tension within the target. In other embodiments, the focused energetics are aligned such that the energy released upon detonation of the energetics impact the target to create a rotational tension within the target.

The focused energetics may be grouped and aligned such that the energy released upon detonation of one group of focused energetics cooperates with the energy released upon detonation of another group of focused energetics to create separation forces within the target on impact.

In the preferred embodiment, the plurality of energetics is a plurality of shaped charges, particularly perforating charges. In this embodiment, the energy generated upon detonation is a shockwave which propels the charge liner, as a jet of plasticised material, towards the target.

The severance tool may further comprise an energetic holder adapted, in use, to be located adjacent the target to be severed, the energetic holder being adapted to receive the energetics.

In this embodiment the energetics holder may be a charge holder.

The shaped charges may be arranged in the charge holder in a tiered array.

The tiered array may be adapted to house two tiers of shaped charges.

In one embodiment, there is at least one first tier shaped charge and at least one second tier shaped charge.

There may be a plurality of shaped charges in at least one of said tiers.

The charge holder may be adapted to at least partially surround the target.

In use, the charge holder may be adapted to fully surround the target.

In at least some embodiments, the target is a tubular element.

In specific embodiments, the tubular element is a drill pipe.

In other embodiments, the tubular element is a riser. It will be understood the tubular element can be any tubular component which passes into an oil well such as a drill collar or tool or the like.

Alternatively the target may be non-tubular.

The severance tool may define a through bore.

The through bore may be adapted to receive the target.

Where the severance tool defines a through bore adapted to receive the target, the charge holder may be adapted to encircle the target.

Where the charge holder is a ring, each shaped charge may be adapted to direct a jet of material radially inwards.

Each shaped charge may be adapted to direct a jet of material towards, in use, a target longitudinal axis.

The shaped charges on one tier may be aligned to direct a jet of material towards a different point on target longitudinal axis than the shaped charges of a different tier.

Where the charge holder is adapted to encircle the target, the charge holder may define a longitudinal axis.

In a preferred embodiment, the charge holder longitudinal axis, in use, is the same as the target longitudinal axis.

The severance tool may comprise a centralising means adapted to centralise the target with respect to the shaped charges. A centraliser can be used to move the target such that the target longitudinal axis substantially coincides with the ring longitudinal axis.

The severance tool may comprise isolating means adapted to isolate the target locations from a wellbore environment.

The severance tool may be adapted to seal the target locations from the wellbore environment.

The severance tool may comprise a removal device adapted to remove a wellbore medium from the vicinity of the target locations. Fluids and solids within the wellbore can provide an extremely dense medium through which the jets of material released by detonation of the shaped charges have to pass. This can significantly reduce the energy of the jet of material and have an adverse effect on its ability to sever the target.

The severance tool removal device may be adapted to replace the wellbore medium with an alternative solid or fluid. By replacing the wellbore medium with an alternative solid or fluid, the alternative solid or fluid chosen can be of lower density, thereby reducing the energy lost during passage of the jets or material to the target.

According to a second aspect of the present invention there is provided a severance tool for severing a target, the severance tool comprising:

a housing;

a plurality of shaped charges;

a charge holder adapted, in use, encircle the target to be severed, the charge holder being adapted to receive the shaped charges;

a trigger mechanism adapted to activate the shaped charges; and a centralising means adapted, in use, to create relative movement between the target and the charge holder to centralise the target with respect to the charge holder.

According to a third aspect of the present invention there is provided a charge holder for holding shaped charges, the charge holder having a through bore, the through bore having a longitudinal axis, the housing further defining a plurality of pockets, each pocket adapted to receive a shaped charge, at least one of the pockets being aligned such that, in use, upon detonation of a shaped charge contained within said pocket or pockets, a jet of material formed travels into the through bore in a travel direction, the/each travel direction being selected to avoid the through bore longitudinal axis.

In an embodiment where there are multiple pockets aligned such that in use, upon detonation of the shaped charge contained within said pockets, at least some of the travel directions are selected to both avoid the through bore longitudinal axis and create torsion within the target.

According to a fourth aspect of the present invention there is provided a method of severing a tubular, the method comprising the steps of:

providing a severance tool, the tool defining a through bore, the through bore receiving the tubular is to be severed;

detonating a plurality of focused energetics housed within a severance tool housing, the focused energetics upon detonation releasing energy, the energy of one focus energetic cooperating with the energy released by another focus energetic to establish a separating force within the target material upon impact.

According to a fifth aspect of the present invention there is provided a severance tool for severing a target, comprising:

at least one shaped charge, the/each shaped charge being adapted to detonate upon receipt of an activation signal, the/each shaped charge being adapted to release energy on detonation, a first portion of the released energy being released in a first direction, the first direction being at least partially determined by the geometry of the/each shaped charge; and at least one trigger adapted to send the activation signal to the/each shaped charge.

In at least one embodiment of the invention, providing a shaped charge to sever, for example, a well tubular provides for greater control over the severing process because the shape of the charge substantially determines the direction of the energy released by the charge on detonation.

The released energy may be in the form of a shockwave.

Particularly, the released energy may be in the form of a jet of material.

The jet of material may be a high velocity jet of material.

The jet of material may include, but is not limited to, a metallic material, a glass material, a ceramic material or any suitable material.

In some embodiments the jet of material may be a combination of materials.

The first portion of the released energy may be more than 50% of the energy released by the detonation.

The first portion of the released energy may be more than 75% of the energy released by the detonation.

The first direction may, in use, be towards a first target location.

Upon detonation the/each shaped charge may release a second portion of released energy, the second portion being released in a second direction.

The second direction may, in use, be towards a second target location, the second target location being different to the first target location.

The/each shaped charge may define at least one geometry.

The/each shaped charge may define a plurality of geometries.

The/each shaped charge geometry may be conical, oval, linear or any suitable shape.

In a preferred embodiment there is a plurality of shaped charges.

In embodiments where there is a plurality of shaped charges, each shaped charge may define a geometry or a plurality of geometries.

In these embodiments, the may be one shaped charge defining a geometry or plurality of geometries which is different to another shaped charge.

Where there is a plurality of shaped charges, the shaped charges may be positioned such that at least one shaped charge can be detonated in isolation from another at least one shaped charge.

It may be preferable to ensure the detonation of one shaped charge does not trigger the detonation of an adjacent shaped charge.

Alternatively or additionally, the geometry of the shaped charges may be selected to direct energy released on detonation away from the/each other shaped charge.

In at least one embodiment, at least one of said shaped charges is adapted, in use, to be located adjacent to the target.

In some embodiments at least one of said shaped charges is adapted to be connected to the target.

The/each charge may be connected to the target by any suitable means. For example the/each charge may be adhered to the target for example, or pressed into a recess provided on the target.

In preferred embodiments, at least one of said shaped charges is adapted to be spaced away from the target.

The severance tool may further comprise at least one charge holder adapted to hold at least part of the/each shaped charge. The/each charge holder is provided, in use, to for example position the/each shaped charge such that the first direction of the/each shaped charge is aligned with the first target location on the target, such that upon detonation the released energy has maximum effect on impact with the target.

The charge holder may be adapted to hold a single charge.

Alternatively the charge holder may be adapted to hold a plurality of charges.

In some embodiments, there is a plurality of charge holders.

In these embodiments, each charge holder may be adapted to receive the least part of the/each shaped charge.

In some embodiments, there may be a charge holder associated with each shaped charge. Alternatively there may be a single charge holder adapted to hold a plurality of charges.

In some of these embodiments, and in other embodiments, the/each charge holder may define a charge holder geometry, the charge holder geometry being selected to direct energy released from the shaped charge.

The charge holder geometry may direct energy released from the shaped charge, in use, towards the target. Alternatively or additionally, the charge holder geometry may direct energy released from the shaped charge, in use, away from an undetonated shaped charge.

Controlling the released energy is important, as not all the energy released can be directed at the target. Energy which it is unable to direct at the target can trigger a detonation of another charge in the same holder or another holder.

The charge holder geometry may, for example, define a convoluted path for the released energy.

In some embodiments, the/each charge holder geometry may at least partially reflect the released energy.

The/each charge holder geometry may be adapted to absorb at least some of the energy reflected off it.

The/each charge holder may comprise a polymer.

Alternatively the/each charge holder may comprise a metal.

The metal may be steel.

Alternatively or additionally the/each charge holder may comprise a material adapted to retard the velocity of the released energy. Retarding the velocity of the released energy reduces the possibility that an adjacent charge is not detonated intentionally.

The/each charge holder may define at least one charge storage location.

The/each charge storage location may be a pocket.

The/each charge holder may define a plurality of pockets.

The severance tool may further comprise an energy attenuation device. An energy attenuation device may be provided to inhibit a flow of released energy. The energy attenuation device may be adapted to slow a flow of released energy.

The energy attenuation device may comprise a solid, a composite and/or an aerated solid. Aerated solids such as foams comprise pockets of air which may slow the travel of a flow of released energy. Composite materials may also provide beneficial shock attenuation.

The severance tool may further comprise an energy damping device. The energy damping device may be provided to absorb residual energy after detonation once the target has been severed.

The energy damping device may be adapted to generate a gas.

The gas may be generated prior to detonation.

The energy damping device may be adapted to generate the gas such that the gas is in the vicinity of the direction of travel of the released energy when the/each shaped charge is detonated.

The gas may be generated by a combustion, injection, vibration, chemical reaction or flow of electricity. Any suitable method for generating gas may be employed.

The gas may be in the form of bubbles. Bubbles of gas can absorb residual energy after detonation.

The energy released by detonation may, in use, pass through an environmental medium, the environmental medium being located between the/each shaped charge and the target to be severed.

The severance tool may further comprise a preferred medium generating or storage device.

The preferred medium is a material which is adapted to at least partially displace the environmental medium if a preferred medium can be located, the preferred medium having a lower density than the environmental medium. It is preferred to have as low a density medium as possible on the flow path as the density of the medium affects the energy of the shockwave, energy being absorbed by higher density materials reducing the severance energy available.

The preferred medium may be a gas.

The gas may be air, nitrogen, carbon dioxide or any suitable gas.

Alternatively or additionally the flow path substance may be a low density fluid. For example, a light oil may be used.

Alternatively or additionally the flow path substance may be a solid. Any fluid or solid of lower density than the environmental medium will increase the energy available for severing the target as the lower density preferred medium will absorb less energy than the environmental medium.

Where the preferred medium is a gas, the gas may be in the form of bubbles. Bubbles of gas are preferred as they can both provide a lower density medium through which the shock wave can travel and the bubbles can also provide a shock damping means.

The preferred medium generation or storage means may comprise a vessel adapted to store a preferred medium.

The vessel may be positionable adjacent the target.

The vessel may be adapted to displace the environmental medium.

The vessel may be an air bladder.

The air bladder may be inflatable.

The severance tool may comprise a target positioning means. A positioning means may be provided to position the target in the optimum position to maximise the severance effect of the tool.

The positioning means, in use, may be adapted to contact at least part of the target to move the target with respect to the/each shaped charge.

The positioning means may include an engagement member.

The engagement member may be adapted to contact the target.

The engagement member may be mechanically actuated.

The engagement member may be solid.

Alternatively the engagement member may be resilient.

The engagement member may be moveable from a first position to a second position, movement to the second position moving the target to the desired location.

Alternatively, the engagement member may be fixed with respect to the/each shaped charge, the engagement member guiding the target to the desired location and/or restricting the target from moving away from the desired location.

In alternative embodiments the engagement member may transform in moving from the first position to the second position.

The engagement member may transform by inflation.

In some embodiments the engagement member may be an inflatable torus, inflation of said torus centralising the target with respect to the/each shaped charge.

In embodiments where the shaped charges are located radially, in use, with respect to the target, the positioning means may be adapted to centralise the target with respect to the shaped charges.

There may be more than one positioning means.

Where there is a plurality of positioning means at least one of said positioning means may be located on either side of the target.

Additionally or alternatively a positioning means may be on the direction of travel towards the target by the energy released by detonation.

In an embodiment, where the positioning means is located on the direction of travel towards the target by the energy released by detonation, the energy travels through the positioning means. This is of benefit where the positioning means is, for example, an air filled bladder and the air is of lower density than the flow path medium.

Where there is a plurality of shaped charges, the trigger may be adapted to detonate a plurality of the shaped charges simultaneously. It is believed that simultaneous detonation of more than one charge focused at a target results in an increased severance energy due to a compounding of energy at the target.

Where there is a plurality of shaped charges, the trigger may be adapted to detonate a shaped charge or a combination of shaped charges in a sequence with another shaped charge or combination of shaped charges.

The shaped charges may be triggered in a sequence such as at predetermined intervals to maximise the severance effect.

At least some of the energy released by the/each shaped charge may, in use, be directed to apply an axial force and/or torsional force to the target According to a sixth aspect of the present invention there is provided a well emergency separation tool for separating a tubular element, comprising:

at least one shaped charge, the/each shaped charge being adapted to detonate upon receipt of an activation signal, the/each shaped charge being adapted to release energy on detonation, a first portion of the released energy being released in a first direction, the first direction being at least partially determined by the geometry of the/each shaped charge; and at least one trigger adapted to send the activation signal to the/each shaped charge.

According to a seventh aspect of the present invention there is provided a method of severing a target, the method comprising the steps of:

providing at least one shaped charge, the/each shaped charge being adapted to detonate upon receipt of an activation signal;

transmitting an activation signal to the at least one shaped charge such that the at least one shaped charge detonates, the at least one shaped charge releasing energy upon detonation, a first portion of the released energy being released in a first direction, the first direction being at least partially determined by the geometry of the/each shaped charge.

It will be understood that the preferred and alternative features listed in connection with one aspect of the invention may be equally applicable to another aspect but have not been for brevity.

BRIEF DESCRIPTION OF THE DRAWINGS

Embodiments of the present invention will now be described with reference to the accompanying drawings in which:

FIG. 5 is a plan view of the charge holder and target of FIG. 1 during detonation of the shaped charges;

FIG. 6 is a close-up view of part of the surface of the target to be severed immediately after impact of the jet of material created by detonation of the shaped charge;

FIG. 7 is a section through the charge holder and target taken along line A-A of FIG. 5;

FIG. 8 is a section through the charge holder and target taken along line B-B of FIG. 5

DETAILED DESCRIPTION OF THE DRAWINGS

Figure 1:
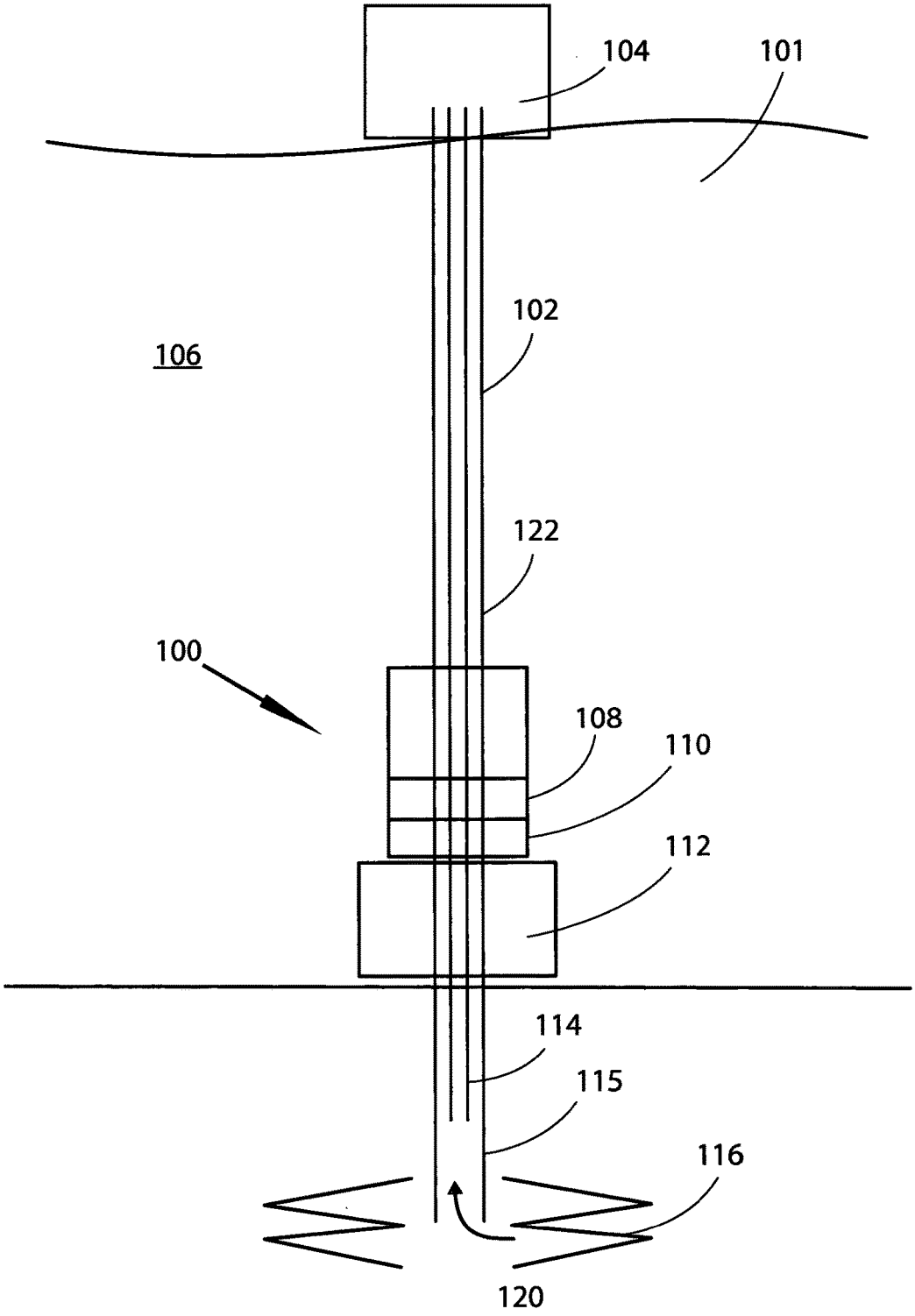
FIG. 1 is a schematic view of a well string incorporating an emergency severance tool according to a first embodiment of the present invention.

FIG. 1 depicts an emergency severance tool, generally indicated by reference numeral 100, according to a first embodiment of the present invention. The emergency severance tool 100 is an element in a chain of well string 101 providing fluid communication between a reservoir 116 and a rig 104. The primary components of the well string 101 are a riser 102, the emergency severance tool 100, a blowout preventer (BOP) stack 112 and a wellbore 115 lined with a casing 114.

The rig 104 floats on the sea 106. The rig 104 is fluidly connected to the emergency severance tool 100 by the riser 102.

Opposite the riser 102, the emergency severance tool 100 is fluidly connected to a flex joint 110 by a connector element 108. The flex joint 110 extends from the connector element 108 to the BOP 112. The flex joint 110 provides a certain degree of movement of the surface structure 104 with respect to the BOP stack 112, to allow for movement of the surface structure in, for example, rough seas. The casing 114 is a tubular element fluidly connected to the BOP stack 112.

In normal use, fluid may flow from the reservoir 116 through the casing 114 towards surface in the direction marked by the arrow 120.

During drilling or workover operations, a workstring 122 may extend from the surface structure 104 to the casing 114. The workstring 122 is contained within the riser 102 and passes through the emergency severance tool 100, the connector element 108, the flex joint 110 and the BOP stack 112.

Figure 2:
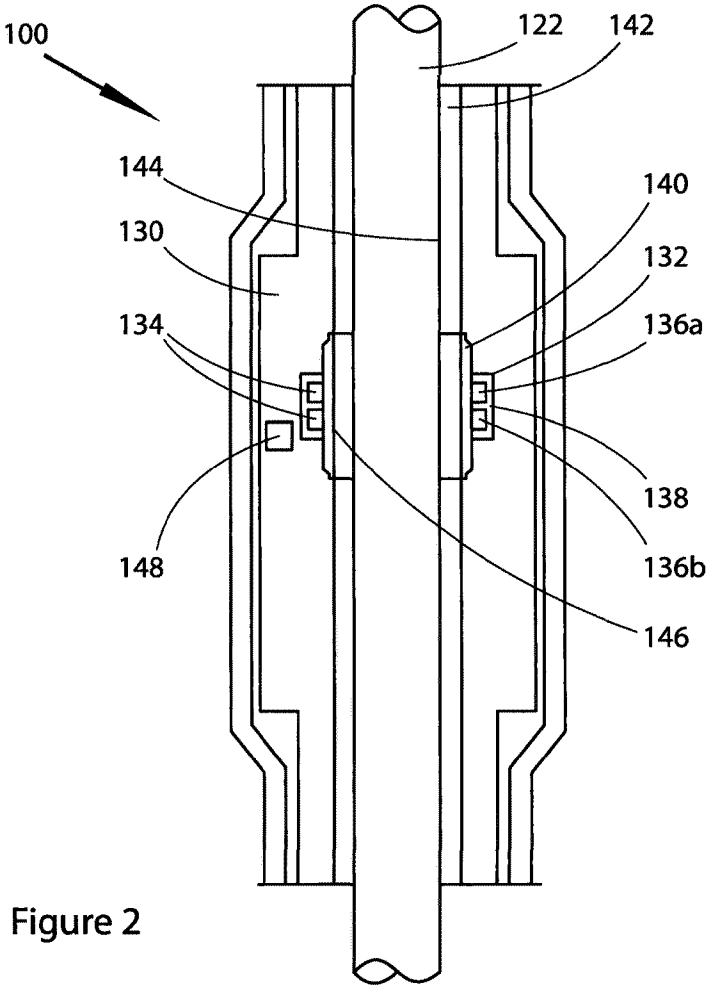
FIG. 2 is a section of the emergency severance tool of FIG. 1.

Reference is now made to FIG. 2, a section of the severance tool 100 of FIG. 1. The severance tool 100 comprises a housing 130, a charge holder 132, the charge holder 132 containing a plurality of shaped perforating charges 134. The charge holder 132 is adapted to receive the shaped charges 134 in two tiers 136A, 136B. The charger holder 132 is located within a recess 138 defined by the housing 130. The severance tool 100 further comprises a charge barrier, the charge barrier 140 acting as a barrier between the charge holder 132 and a severance tool through bore 142 defined by a housing internal surface 144 and a charge liner internal surface 146.

When the severance tool 100 is exposed to well pressure, the well pressure in the through bore 142 can be extremely high and the charge barrier 140 resists and contains the pressure in the through bore 142 and protects the charge holder 132.

Passing through the through bore 142 is the work string 122 contained within the riser 102 (not shown in FIG. 2).

Finally, the severance tool 100 comprises a trigger 148 adapted to receive a detonation signal and, in response to the signal, detonate the charges 134.

Figure 3:
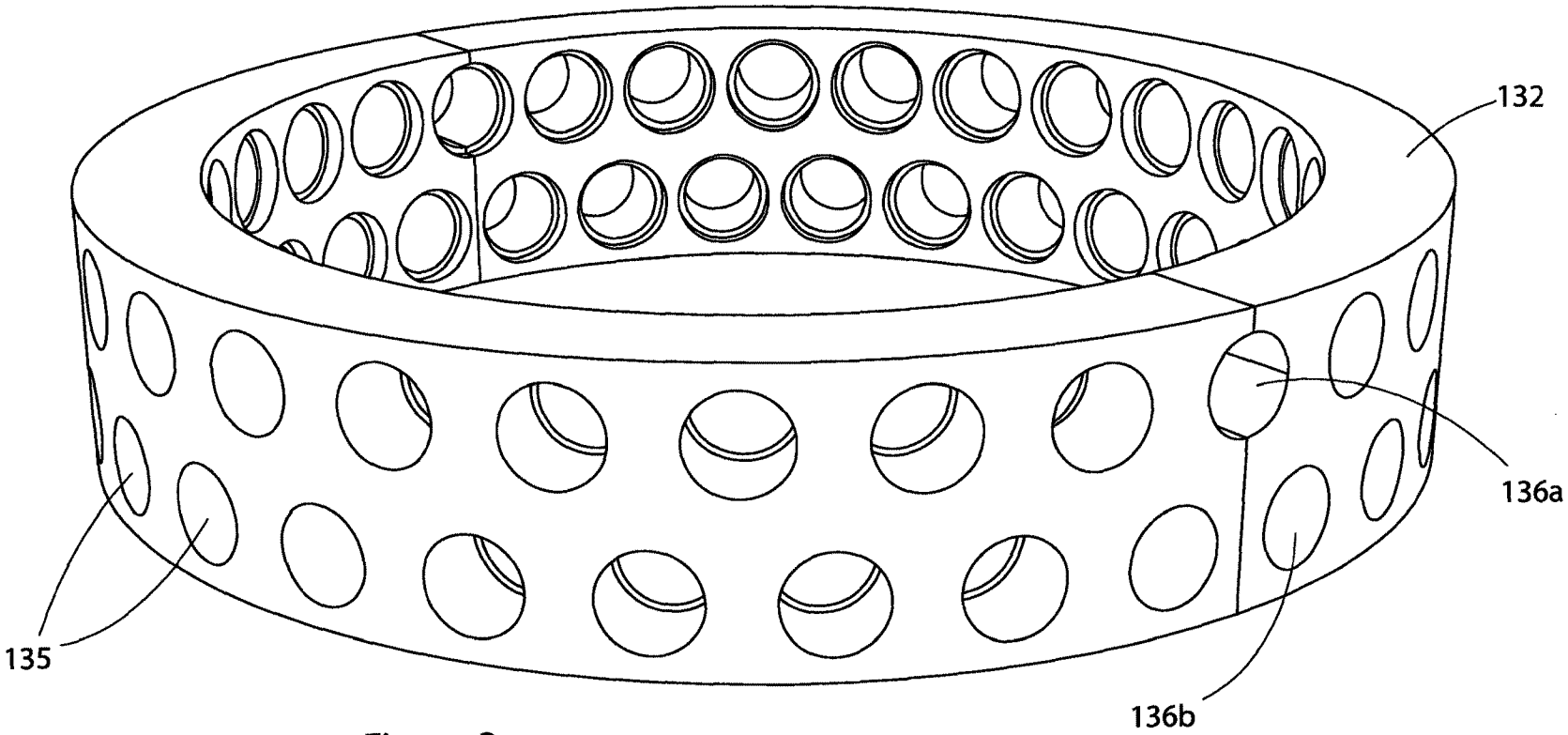
FIG. 3 is a perspective view of the charge holder of the emergency severance tool of FIG. 1.

Reference is now made to FIG. 3 which shows the charge holder 132 defining a plurality of pockets 135 for holding the shaped charges 134 in both the first tier 136*a* and the second tier 136*b*.

The charge holder 132 comprises polyurethane. Polyurethane is chosen because shock waves emanating from one charge can trigger an adjacent charge prior to the detonation signal reaching the adjacent charge. Polyurethane is a relatively poor conductor of shock waves in that the shock waves are retarded compared to other materials such as metal. Using polyurethane gives better control over the detonation which is achieved by each charge being detonated by the charging signal and not by an external influence.

Figure 4:
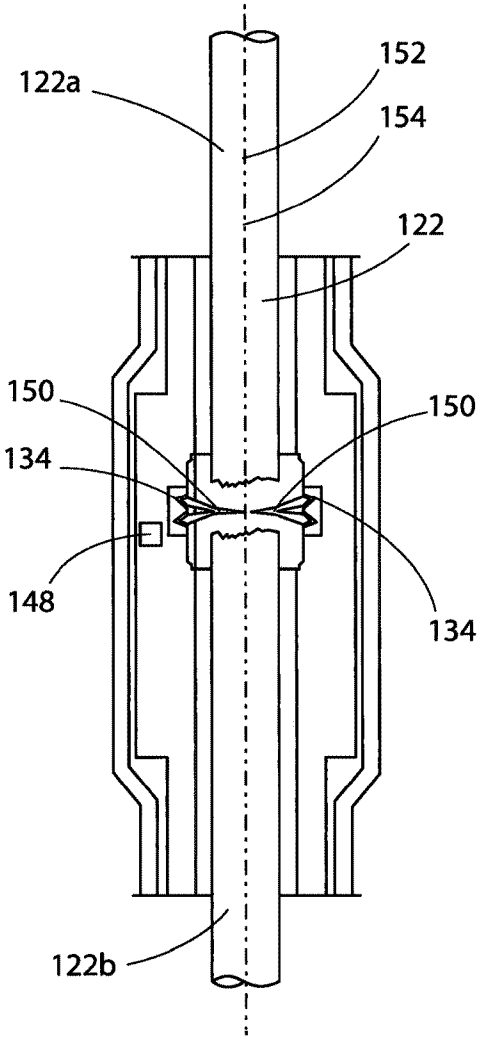
FIG. 4 is a section of the emergency severance tool of FIG. 1 during detonation.

Referring to FIG. 4, detonation of the shaped charges 134 by the trigger 148 causes each shaped charge 134 to explode generating a jet of plasticised material 150 to be propelled towards the target, in this case the well string 122. The jet of plasticised material 150 is created from a liner which is part of the shaped charge 134. The jets of plasticised material 150 from the shaped charges 134 are aligned to converge on a through bore longitudinal axis 152 which in this case coincides with the well string longitudinal axis 154. As can be seen from FIG. 4, the jets of plasticised material 150 sever the tubular 122 into an upper portion 122*a* and a lower portion 122*b*. In this situation, the lower portion 122*b* can then drop below the blow out preventer stack 112, allowing the blow out preventer 112 to seal the well bore casing 114 (all shown in FIG. 1).

The mechanisms of severance of the target 122 will now be described with reference to FIGS. 5-23.

Referring firstly to FIG. 5, in this plan view of the charge holder 132 and the target 122, detonation of the shaped charges 134 has just been realised and the jets of plasticised material 150 have just impinged on a target surface 156.

Referring to FIG. 6, each shaped charge has a target location 158 on the target surface 156. The target locations are arranged into rings 158A, 158B, the upper ring of target locations being the target location for the first tier 136*a* of shaped charges 134 and the second tier 136*b* of shaped charges 134 having a target location of the second target location ring 158B. FIGS. 7 and 8 show the angled travel of the jets of plasticised material 150 towards the point indicated by letter X on FIGS. 7 and 8 where the jets of material 150 converge. This point is midway through a target wall 176.

Figure 10:
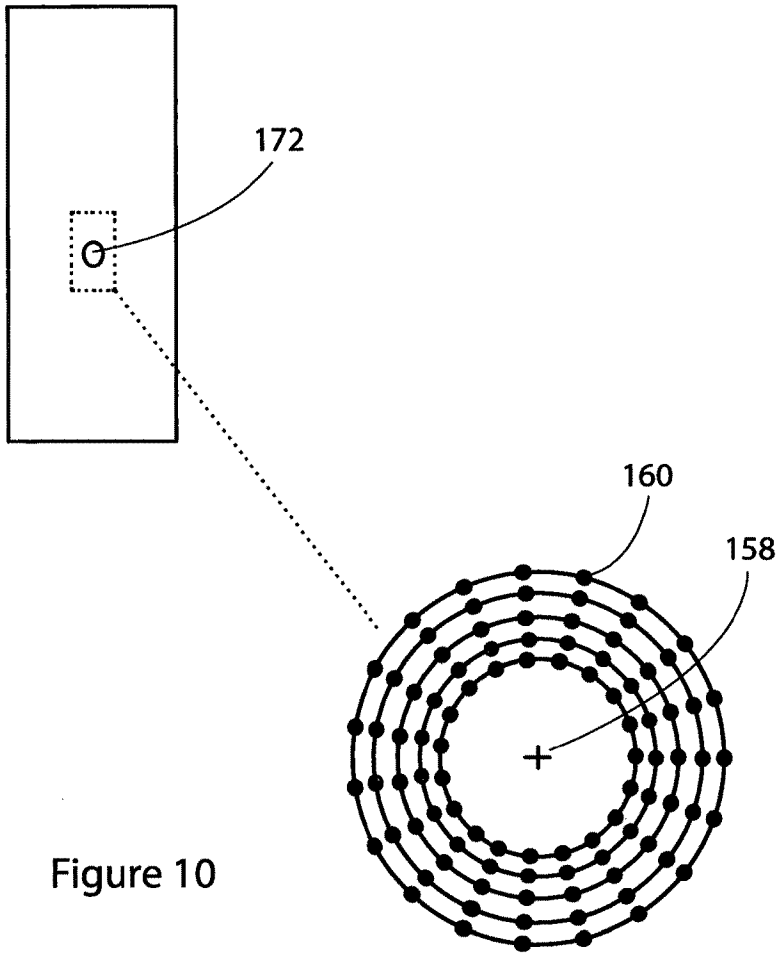
FIG. 10 is a close-up schematic of part of the surface of the target to be severed by the emergency severance tool of FIG. 1 showing the molecular arrangement after impact of the jet of material created by detonation of the shaped charge.
Figure 9:
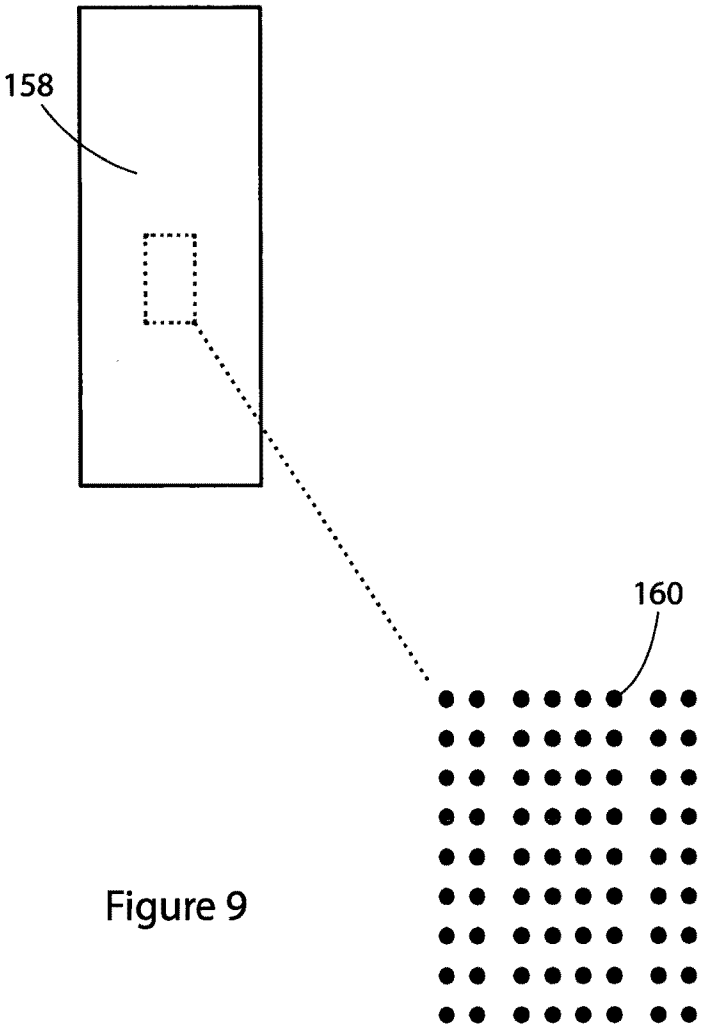
FIG. 9 is a close-up schematic of part of the surface of the target to be severed by the emergency severance tool of FIG. 1 showing the molecular arrangement prior to detonation.

When the jet of material impacts on the well string 122, the action of severance of the well string 122 is not purely a cutting action, rather it is a displacement of material action. Referring to FIGS. 9 and 10, FIG. 9 shows the arrangement of molecules 160 prior to impact of the jet of material 150 on the target 122. As can be seen from FIG. 9, the molecular arrangement is fairly regular as would be expected. When the jet of material 150 impacts on the target location 158 a bore 172 is created by displacement of the molecules 168 from the position shown in FIG. 9 to the position shown in FIG. 10.

Figure 11:
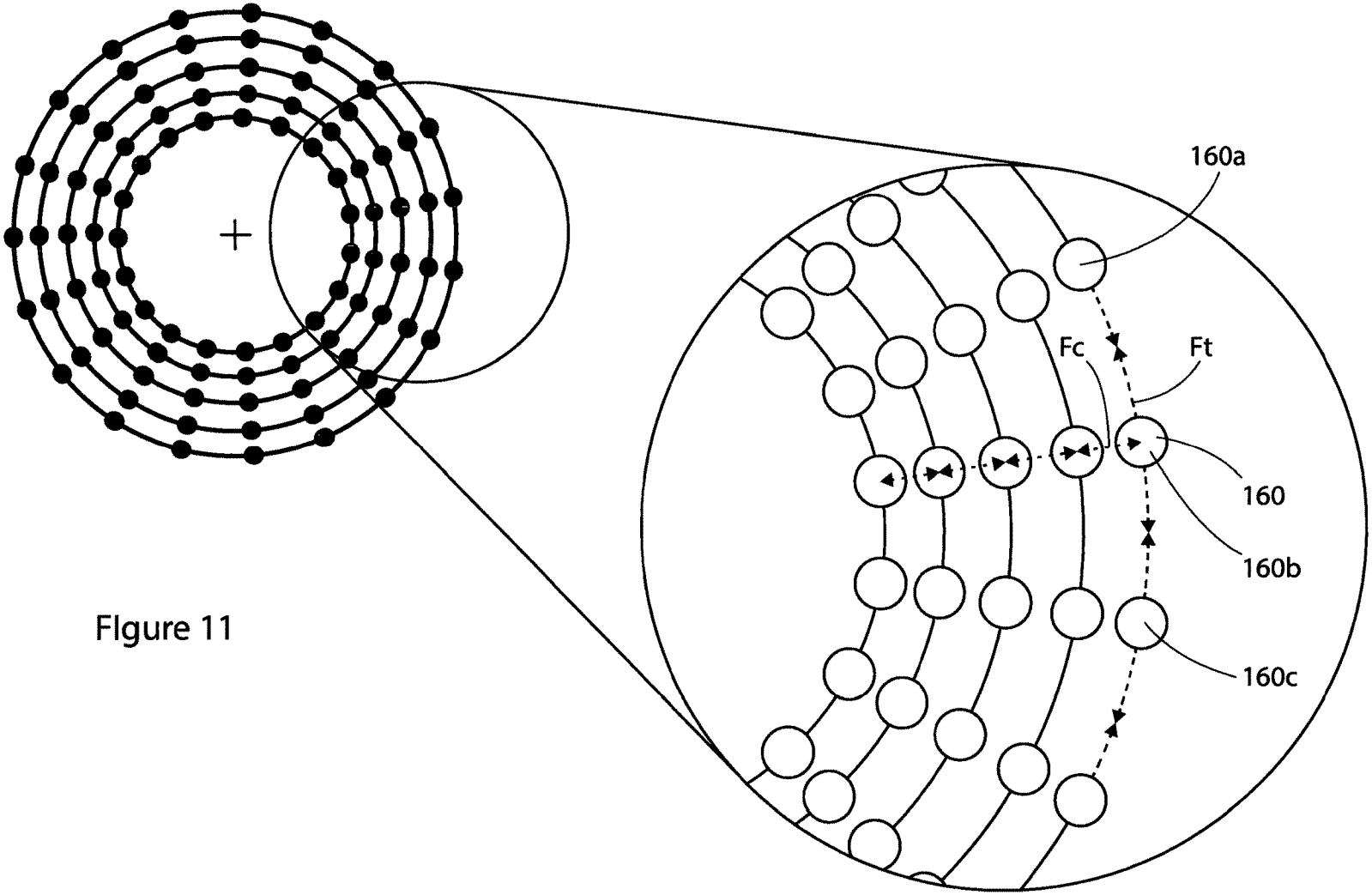
FIG. 11 is a close-up schematic of the forces on the molecular arrangement after impact of the jet of material created by detonation of the shaped charge.

Referring to FIG. 11, it can be seen that in a radial direction the molecules 160 are compressed together by a compression force Fc but in a circumferential direction, particularly the outer molecules 160*a*, 160*b*, 160*c* are pulled apart by tension force Ft.

Figure 12:
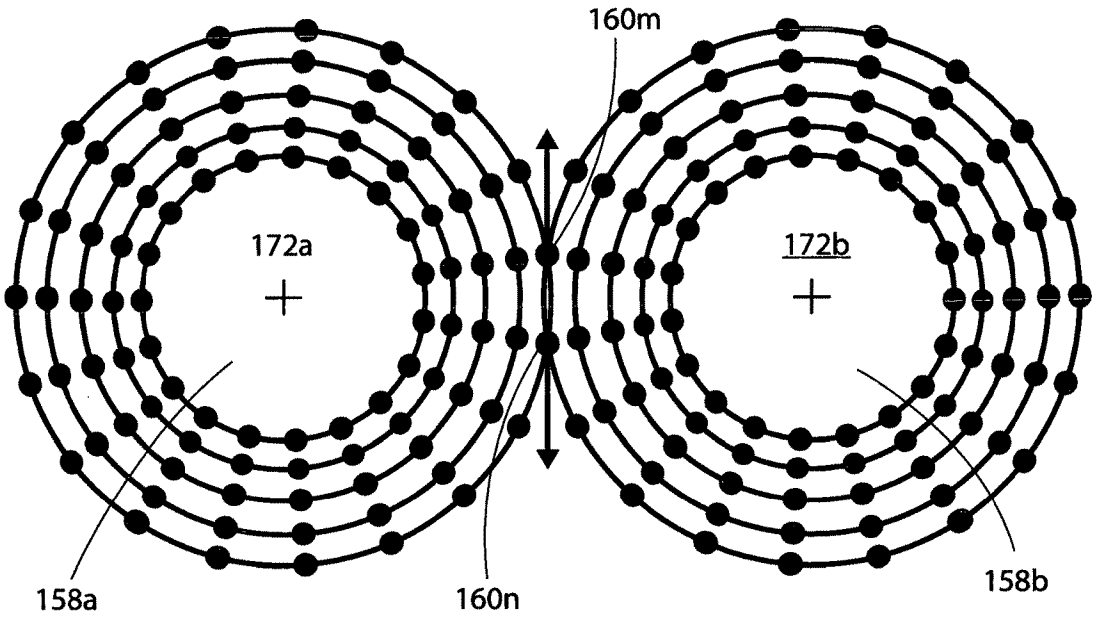
FIG. 12 is a close-up schematic of the forces on the molecular arrangement after impact of the jet of material created by detonation of two detonated shaped charges.
Figure 13:
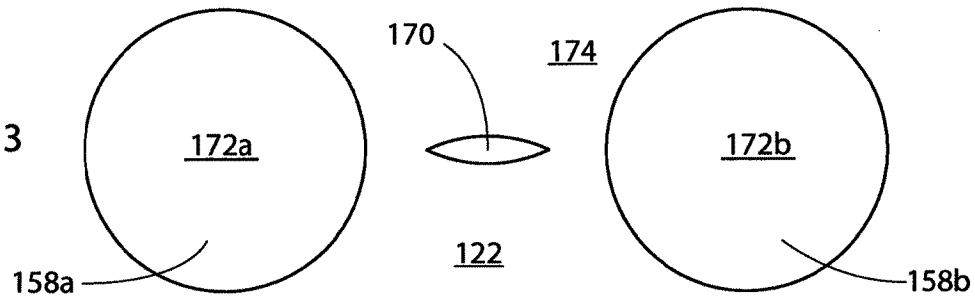
FIG. 13 is a close-up of part of the surface of the targets to be severed of FIG. 1 after impact of two detonated shaped charges.

The effect of the tension force Ft in particular is shown in FIGS. 12 and 13. The target locations 158 and the associated bores 170 are separated by a bridge of material 174 which severs after impact. It is believed that when the molecular displacement of two the adjacent impacts coincide, the summation of the tension forces Tf on adjacent molecules 160M, 160N is such that the bonds between them tear, creating an opening 170 in the bridge material 174 between the target locations 158A, 158B. As the material displacement continues, the opening 170 propagates through the bridge of material 174 until it reaches the bores 172*a*, 172*b* creating a continuous separation from one bore 172*a* to the next bore 172*b*.

Figure 14:
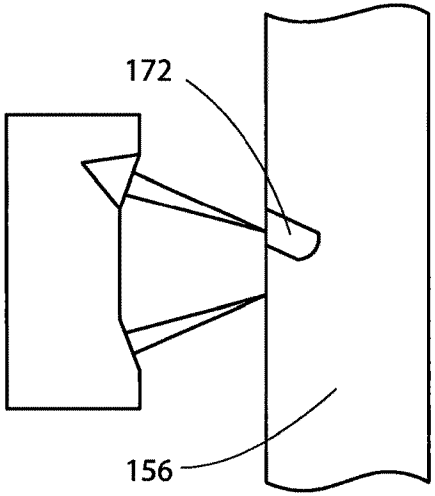
FIG. 14 is a section through the charge holder and target taken along line A-A of FIG. 5 immediately after impact of the jet of material created by detonation of the shaped charge.
Figure 15:
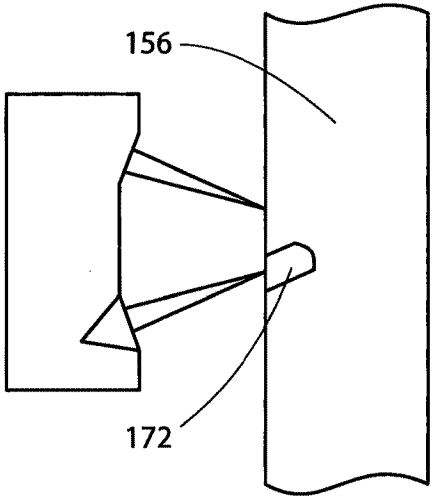
FIG. 15 is a section through the charge holder and target taken along line B-B of FIG. 5 immediately after impact of the jet of material created by detonation.
Figure 16:
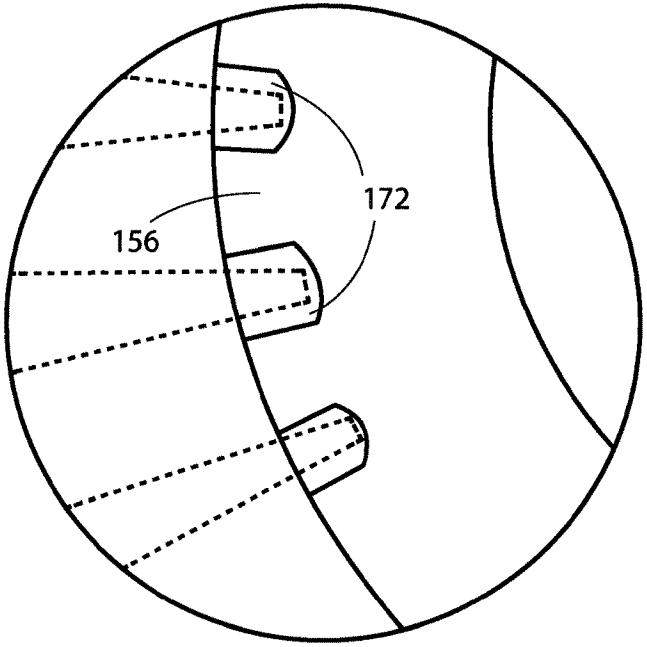
FIG. 16 is a section through part of the target of FIG. 1 immediately after impact of the jet of material created by detonation of the shaped charge.

FIGS. 14, 15 and 16 show the creation of the bores 172 by the initial impact of the jets of material on the target surface 156.

Figure 17:
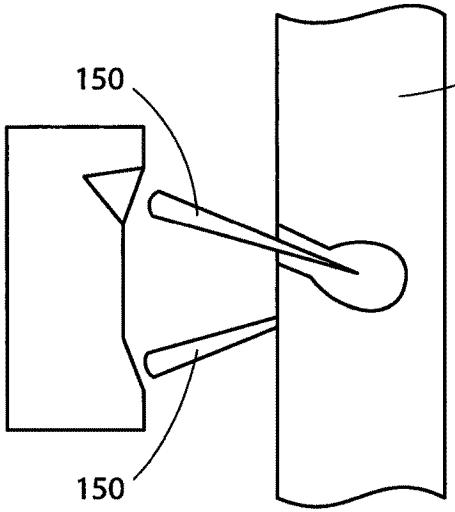
FIG. 17 is a section through the charge holder and target taken along line A-A of FIG. 5 midway through severance of the target of FIG. 1.
Figure 18:
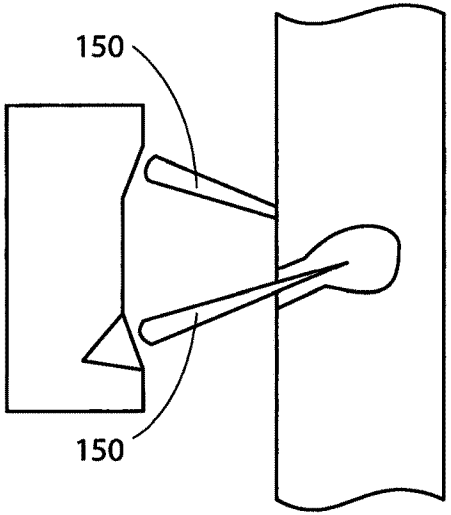
FIG. 18 is a section through the charge holder and target taken along line B-B of FIG. 5 midway through severance of the target of FIG. 1.
Figure 19:
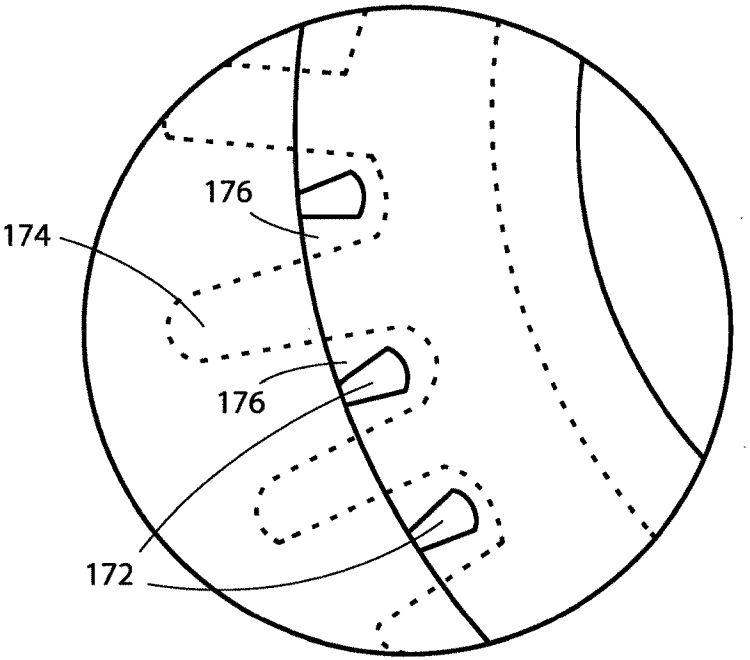
FIG. 19 is a section through part of the target of FIG. 1 midway through severance of the target.

FIGS. 17, 18 and 19 show the next stage in the severance process. Due to convergence of the jets of material 150 caused by the detonation of the shaped charges 134 from the first tier 136*a* and second tier 136*b* as the jets 150 pass through the target wall 176, the bridge of material 174 which exists between the bores 172 created by the jets of material 150 on impact at the target locations reduces to nothing by the time the jets of material 150 reach the centre 178 of the target wall 176. This creates a continuous void 180 around the centre of the target wall 172. During this time the openings 170 caused by the shear forces in the bridges of material 174 left by the jets of material as they pass through the target wall external surface 156 are increasing, ripping through the bridges of material 174. At this point the tubular target 122 is severed for the target external surface 156 through to the centre 178 of the target wall 176.

Figure 20:
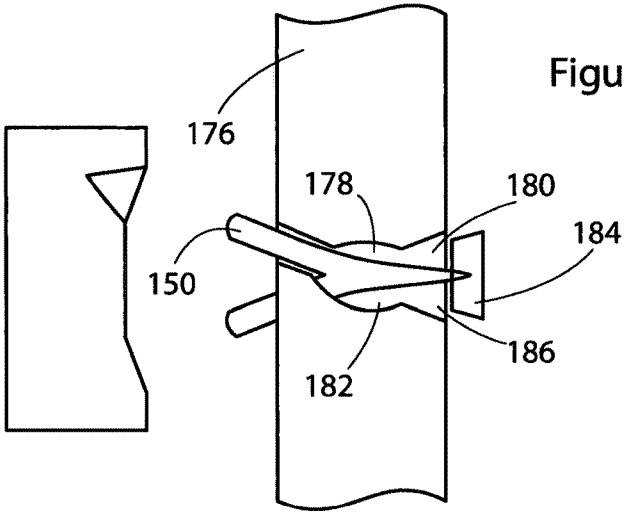
FIG. 20 is a section through the charge holder and target taken along line A-A of FIG. 5 upon completion of severance of the target of FIG. 1.
Figure 21:
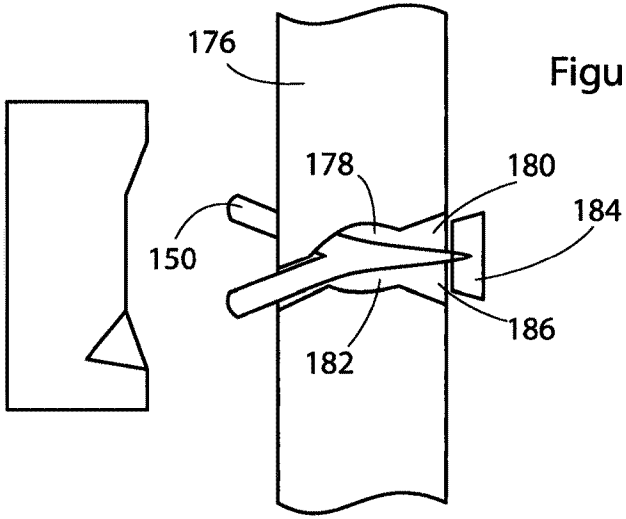
FIG. 21 is a section through the charge holder and target taken along line B-B of FIG. 5 upon completion of severance of the target of FIG. 1.
Figure 22:
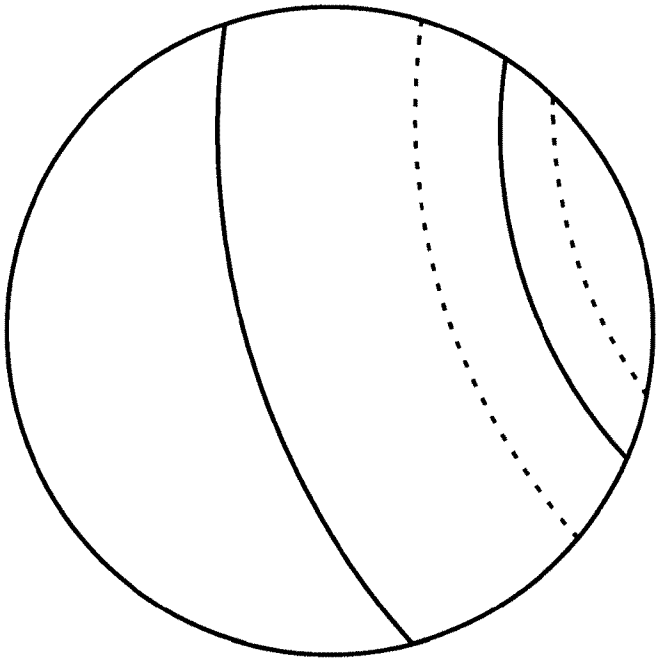
FIG. 22 is a section through part of the target of FIG. 1 upon completion of severance of the target.

Referring to FIGS. 20 to 22, towards the centre 178 of the target wall 176 as the jets of material 150 come together to form the continuous void 180, the jets of material 150 coalesce to effectively form a blade of material 182 which then travels through the remainder of the target wall 176, completing severance of the target 122 by displacing a block of material 184 defining part of the target internal surface 190, to break through into the through bore 186 of the target 122. This effectively completes severance of the target 122.

Figure 23:
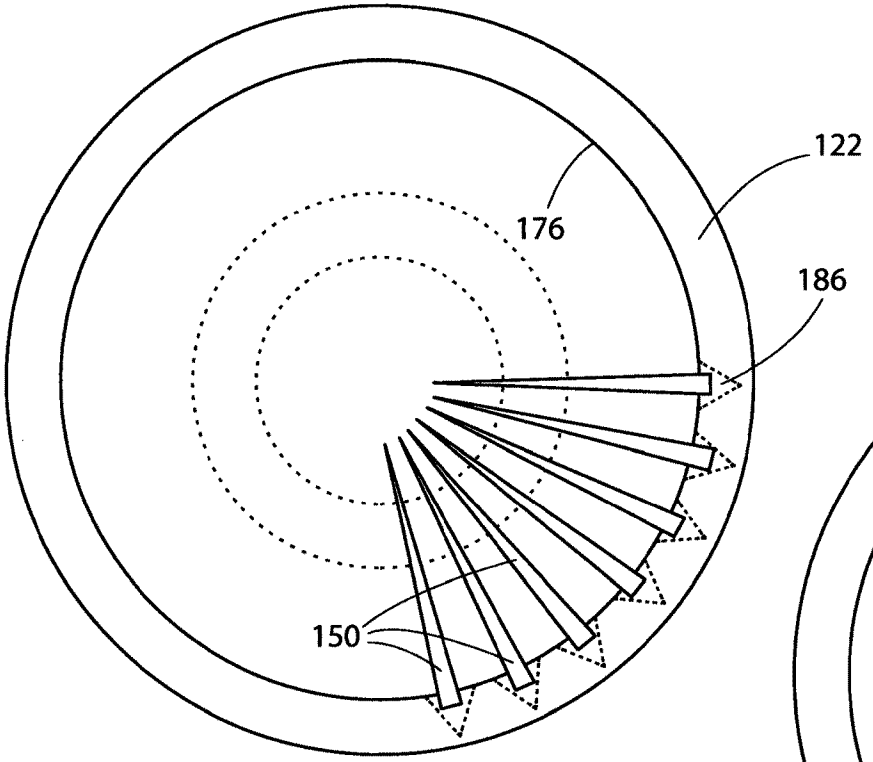
FIG. 23 is a plan view of the direction of firing of some of the shaped charges of the emergency severance tool of FIG. 1.

Referring to FIG. 23, although effective at severing targets 122, the energy of detonation of the shaped charges 134 is not fully utilised as the jets of material 150 pass through the target wall 176 into the target through bore 186. The energy remaining in the jets of material 150 at the point they pass through the target internal surface 190 is effectively wasted.

Figure 24:
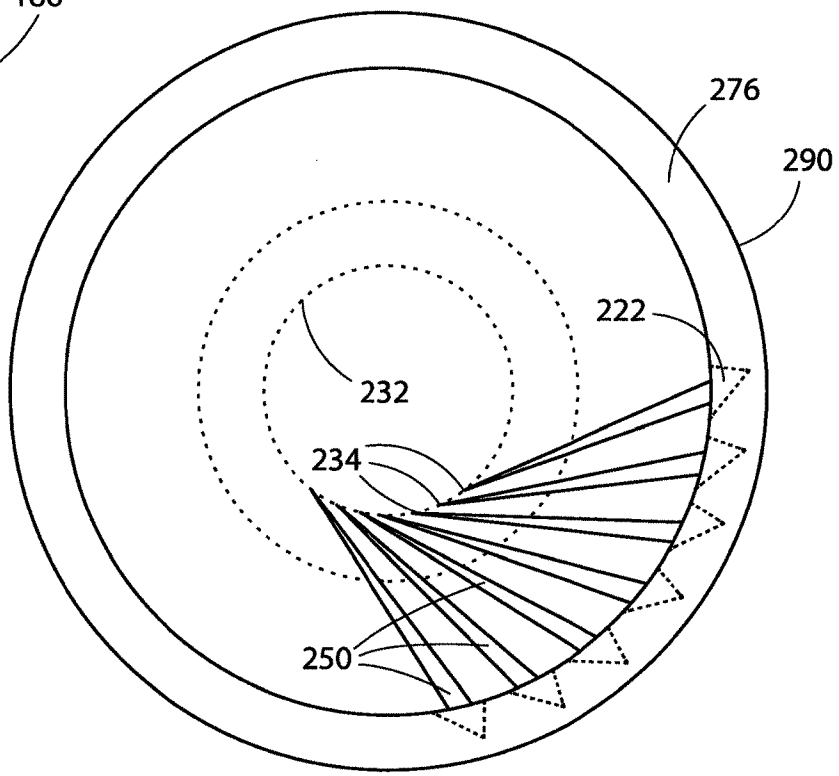
FIG. 24 is a plan view of the direction of firing of some of the shaped charges of an emergency severance tool according to a second embodiment of the present invention.

Reference is now made to FIG. 24, a plan view of a charge ring 232 showing the direction of firing of some shaped charges 234 in accordance with the second embodiment to the present invention. In this embodiment, the shaped charges 234 are aligned to maximise the energy dissipation of the jets of material 250 created by detonation of the shaped charges 234 within the target 222. As can be seen from FIG. 24, the jets of material 250 do not break through the internal target wall surface 290 but rather dissipate their energy as close to the target wall internal surface 290 as is possible.

This has two useful effects, the first as already described is the maximising of the severance effect achievable by the jets of material 250 by dissipating the energy of the jets of material within the target wall 284, and, second, the angle which the jets of material 250 attack the target 222, creates a rotational force within the target wall 276. If a second tier of charges 236*b* or, indeed, a second charge holder (not shown) is fired at the target 222 in a similar way but in the opposite direction, the rotational forces created in the target wall 276 would be in opposite directions. This would create shear forces in a plane perpendicular to the target longitudinal axis which can assist in severance of the target 222.

Four embodiments will now be described with reference to FIGS. 25-31 which tackle the problem of maximising the energy of the jets of material when they reach the target to be severed. The jets of material often lose some energy when travelling from the charge holder to the target because the housing through bore in which the target to be severed is located is often full of a very dense material such as drilling mud. In the embodiments which follow, different methods of dealing with this problem are addressed.

Figure 25:
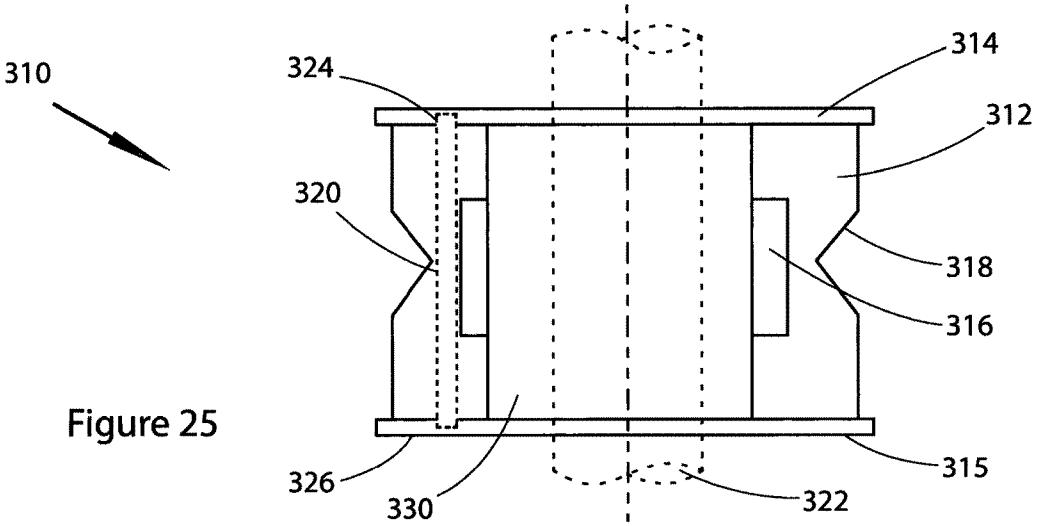
FIG. 25 is a section of part of an emergency severance tool according to a third embodiment of the present invention in an explosives displaced configuration.
Figure 26:
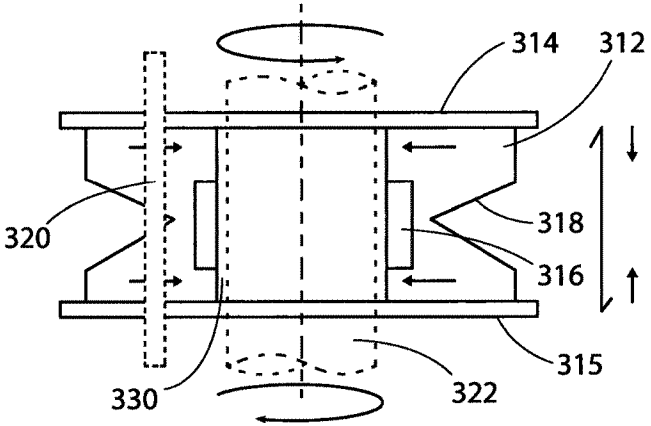
FIG. 26 is a section of part of the emergency severance tool of FIG. 25 in an explosives positioned configuration.

Referring firstly to FIGS. 25 and 26, an emergency severance tool 310, according to a third embodiment of the present invention is disclosed. In this embodiment, the severance tool 310 includes an elastomeric charge holder 312 sandwiched between two charge holder plates 314, 315. The charge holder 312 defines an explosive cavity 318 which is located directly in front of a charge holder recess 320. The upper and lower plates 314, 315 are threadedly attached to a series of support rods 320 (of which one is shown in broken outline) by threaded connections 324, 326 respectively. With the target 322 in position, an annulus 330 between the charge holder 312 and the target 322 is filled with drilling mud (not shown). The maximum diameter of the annulus 330 relates to the diameter of the riser (not shown) and needs to be maintained during normal operation to allow for the passage of well fluids and well tools.

However, in the event that an emergency separation is required, the support rods 320 can be rotated creating movement of the upper and lower plates 314, 315 along the threaded support rods 320, compressing the elastomeric charge holder 312 and causing the charge holder 312 to flex around the recess 318, creating radially inward movement of the explosive cavity 316 and the explosives contained therein towards the target 322.

As the charge holder 312 compresses and moves towards the target 322, the annulus 330 begins to close and the mud contained within the annulus 330 is displaced out of the severance tool 310 minimising the energy loss suffered by the jets of material released by the explosive material within the cavity 316 upon detonation.

This arrangement allows for variable diameters of risers to be accommodated increasing the utility of the device.

Figure 27:
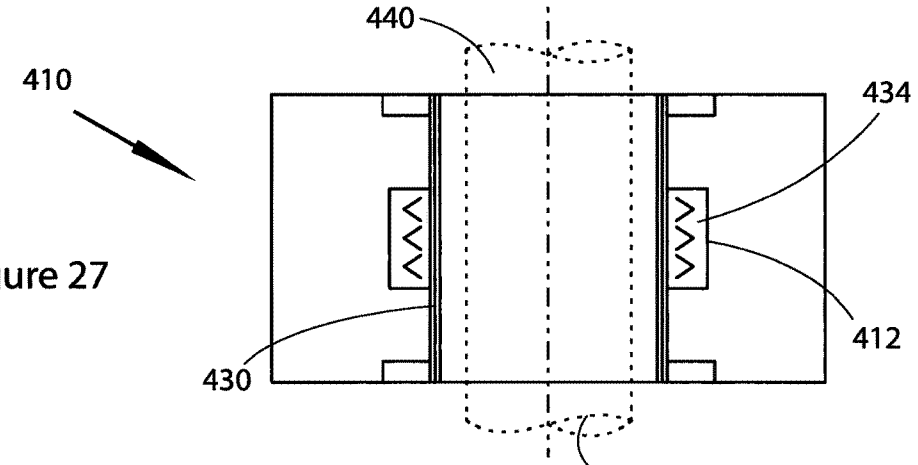
FIG. 27 is a section of part of an emergency severance tool according to a fourth embodiment of the present invention in a pre-well fluid displaced configuration.
Figure 28:
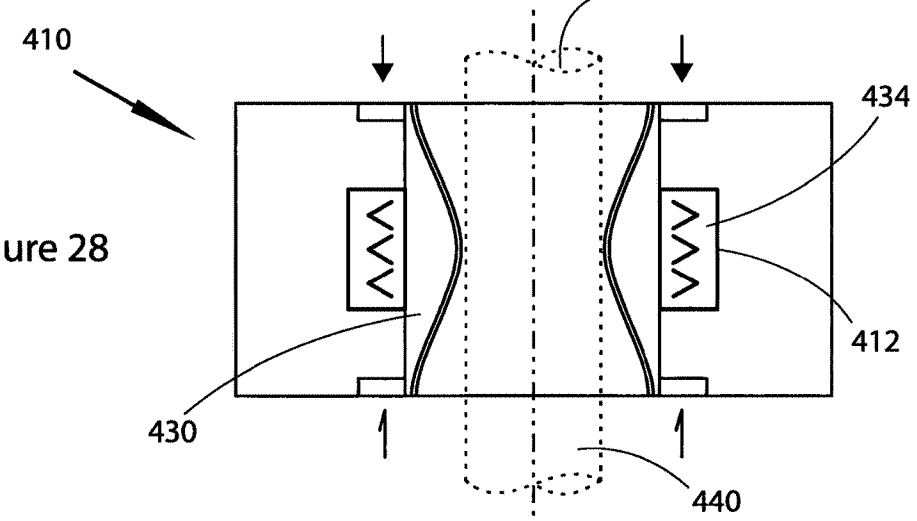
FIG. 28 is a section of part of the emergency severance tool of FIG. 27 in a well fluid displaced configuration.

FIGS. 27 and 28 show an emergency severance tool 410 according to a fourth embodiment of the present invention. This embodiment is similar to the embodiment shown in FIGS. 25 and 26, however this embodiment further includes a bladder 430 located in front of the explosive charge cavity 412. On compression of the charge holder 434, the bladder 430 bows radially inward into engagement with the target 440. On engagement, a void 442 which exists behind the bladder 430 can be filled with a fluid which is of lower density than the fluid in the well bore, assists in minimising the impact of energy loss as the jets of material formed by the explosive charges travel to the target 422.

Figure 29:
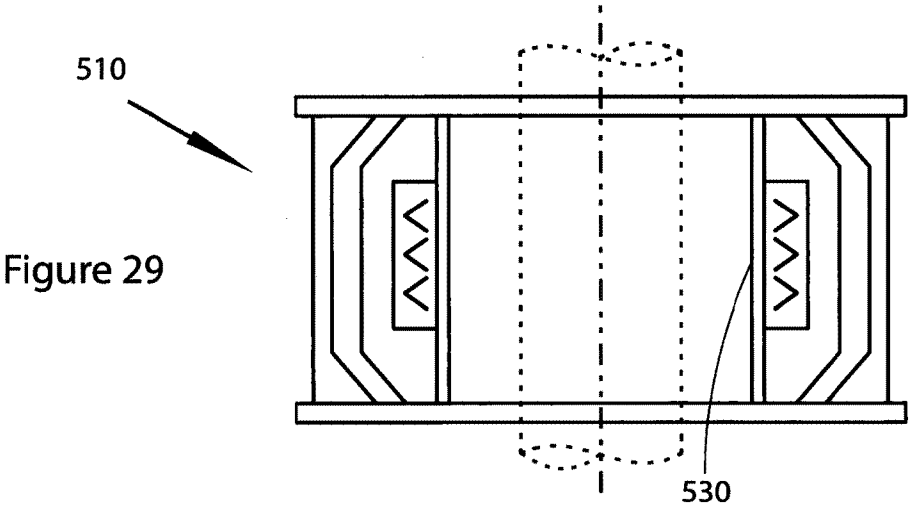
FIG. 29 is a section of part of an emergency severance tool according to a fifth embodiment of the present invention in a pre-well fluid displaced configuration.
Figure 30:
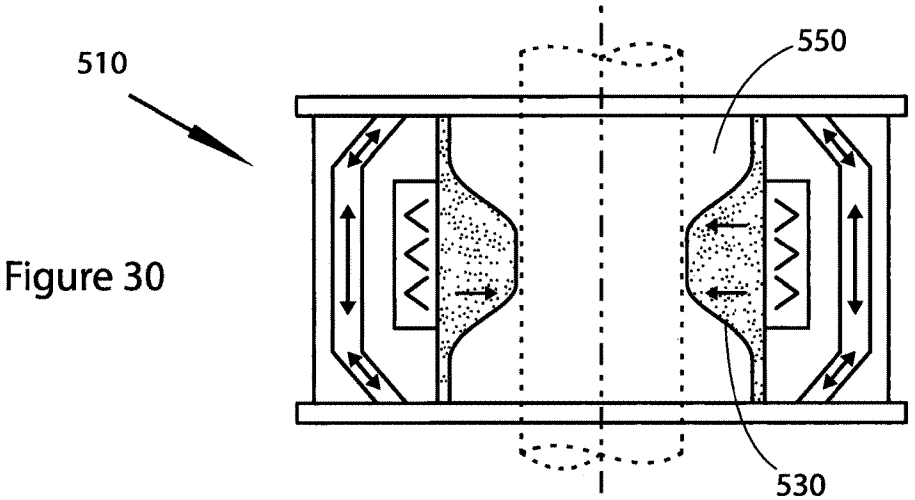
FIG. 30 is a section of the emergency severance tool of FIG. 29 in a well fluid displaced configuration.

FIGS. 29 and 30 show a fifth embodiment of the severance tool 510. This severance tool 510 incorporates a bladder 530 filled with lower density fluid 550 to reduce energy loss, improving penetrative power and accuracy. The tool 510 further includes a fluid bypass 550 to assist in the displacement and flow of fluid through the well reducing pressure on the severance tool 510 from well fluid being pumped in or out of the well.

Figure 31:
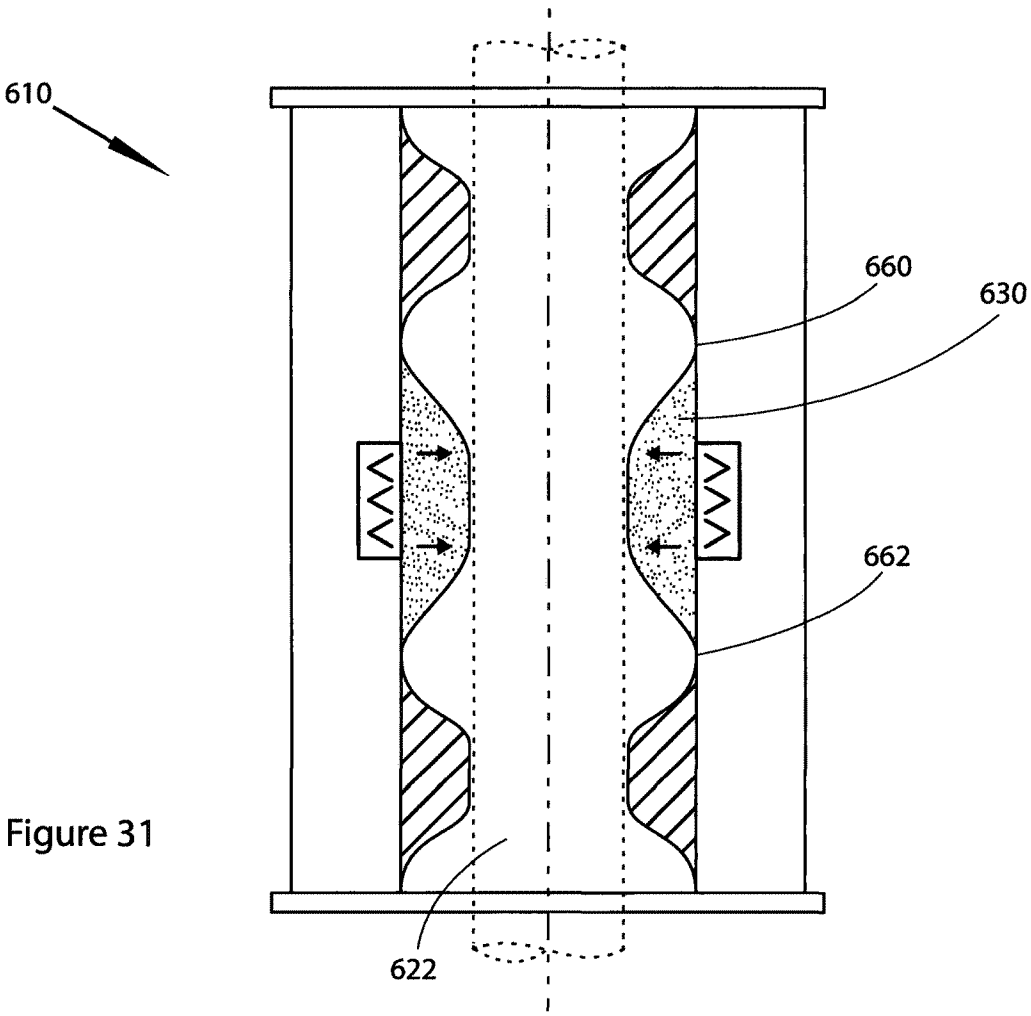
FIG. 31 is a section of part of an emergency severance tool according to a sixth embodiment of the present invention in a well fluid displaced configuration.

FIG. 31 shows a sixth embodiment of the invention in which the tool 610 further includes a first seal 660 positioned above the bladder 630 and a second seal 662 positioned below the bladder 630 to protect the bladder 630 by sealing against the target 622 to be severed.

Figure 32:
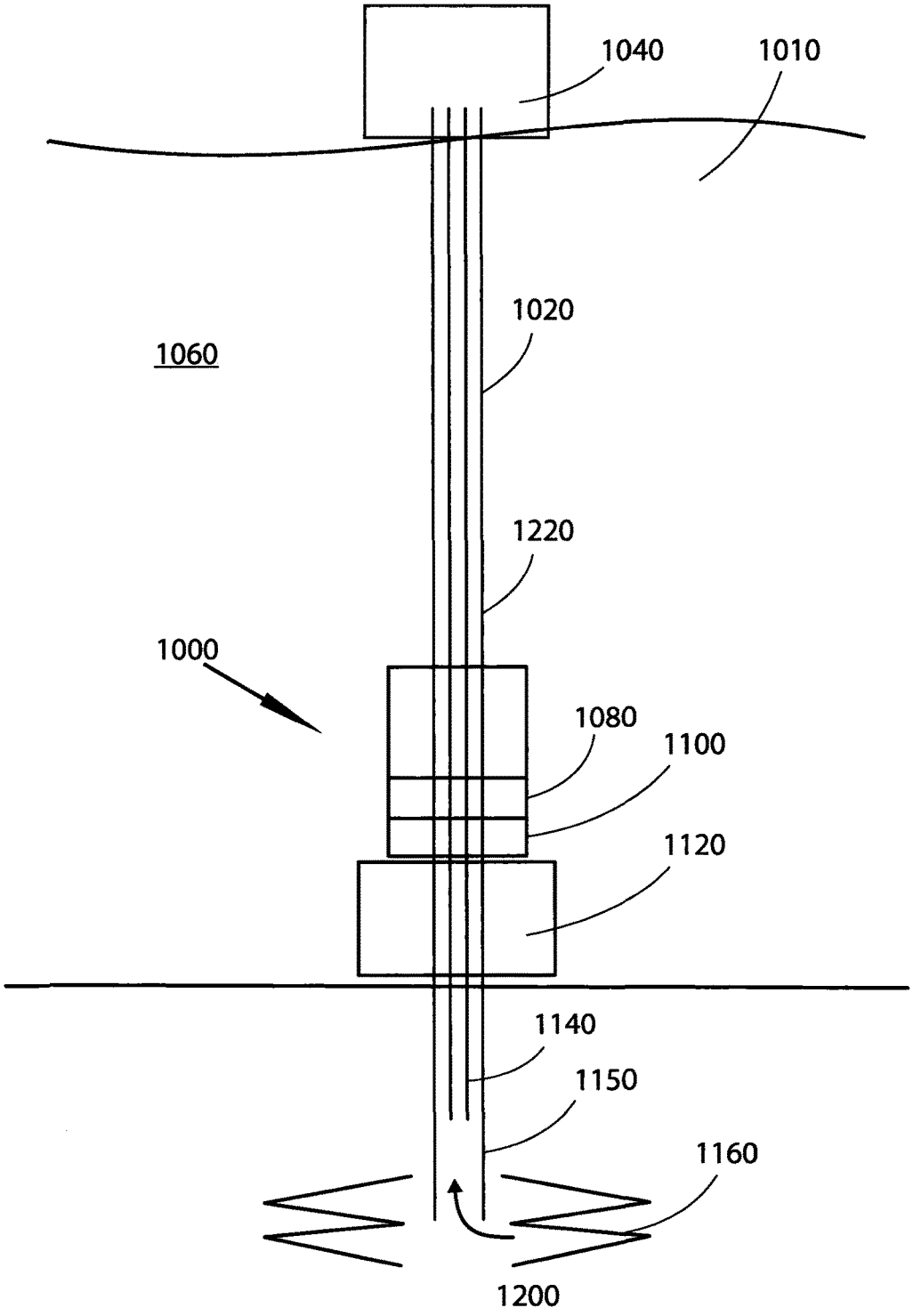
FIG. 32 is a schematic diagram of a well emergency separation tool positioned above a subsea reservoir according to a seventh embodiment of the present invention.

FIG. 32 depicts a severance tool, generally indicated by reference numeral 1000, in the form of a well emergency separation tool according to a seventh embodiment of the present invention. The well emergency separation tool 1000 is an element in a chain of well string 1010 providing fluid communication between a reservoir 1160 and a surface structure 1040. The primary components of the well string 1010 are a riser 1020, the well emergency separation tool 100, a blowout preventer (BOP) stack 1120 and a wellbore 1150 lined with a casing 1140.

The surface structure 1040 floats on the sea 1060. The surface structure 1040 may be, for example, a spar, a semisub, a TLP, an FPSO, a temporary or permanent storage system, a vessel, another containment apparatus, or a separator that separates components of fluid, such as gas and liquid, etc.

The surface structure 1040 is fluidly connected to the well emergency separation tool 1000 by the riser 1020.

Opposite the riser 1020, the well emergency separation tool 1000 is fluidly connected to a flex joint 1100 by a connector element 1080. The flex joint 1100 extends from the connector element 1080 to the BOP 1120. The flex joint 1100 provides a certain degree of movement of the surface structure 1040 with respect to the BOP stack 1120, to allow for movement of the surface structure in, for example, rough seas. The casing 1140 is a tubular element fluidly connected to the BOP stack 1120.

In normal use, fluid may flow from the reservoir 1160 through the casing 1140 towards surface in the direction marked by the arrow 1200.

During drilling or workover operations, a workstring 1220 may extend from the surface structure 1040 to the casing 1140. The workstring 1220 is contained within the riser 1020 and passes through the well emergency separation tool 1000, the connector element 1080, the flex joint 1100 and the BOP stack 1120.

Figure 33:
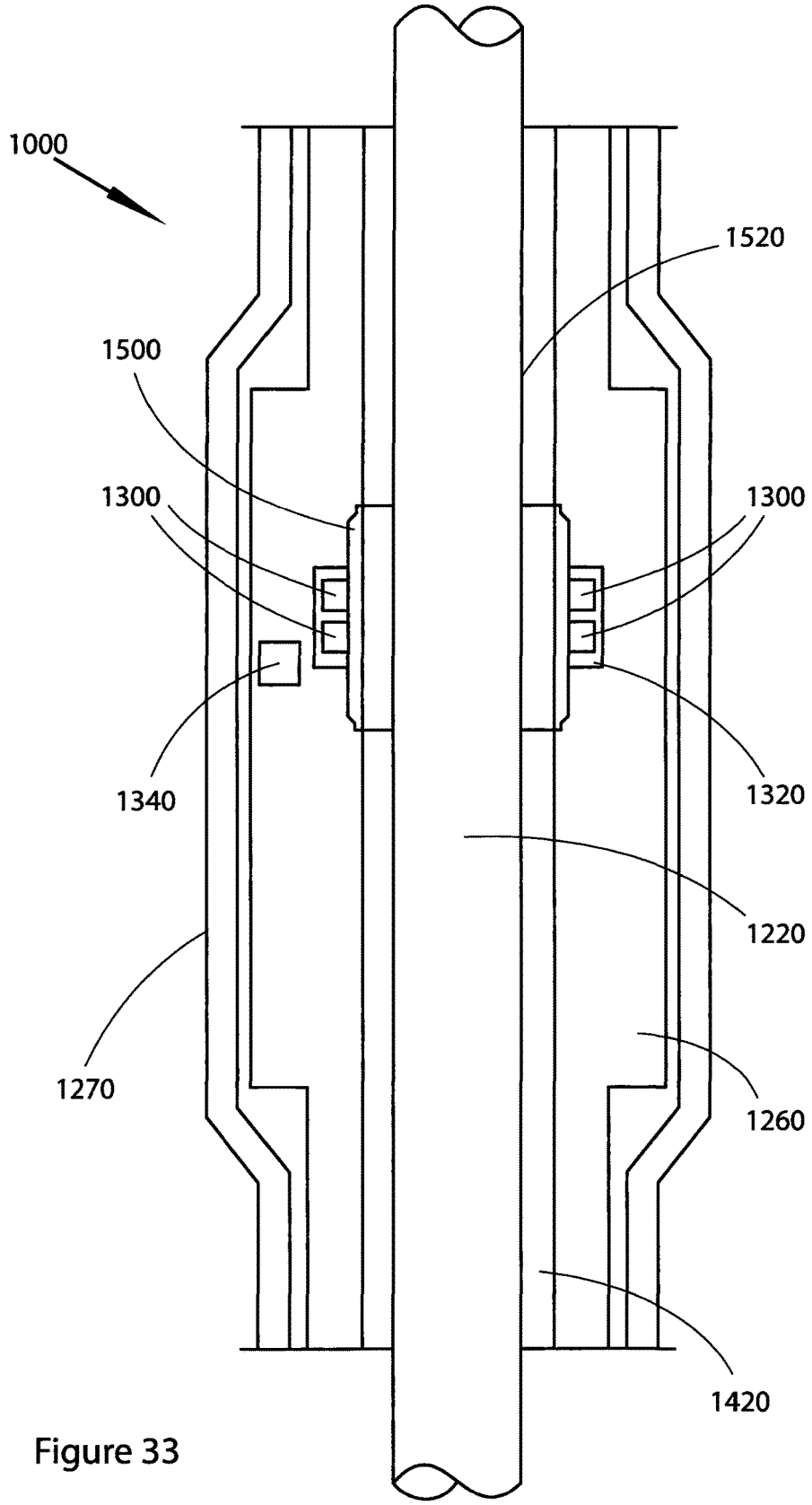
FIG. 33 is a schematic diagram of the internal structure of the well emergency separation tool of FIG. 32.

Referring now to FIG. 33, a schematic diagram of the internal structure of the well emergency separation tool 1000 of FIG. 32 is shown. The well emergency separation tool 1000 comprises a plurality of shaped charges 1300, each shaped charge 1300 being adapted to detonate upon receipt of an activation signal from a trigger 1340.

The charges 1300 are held within a charge carrier 1320 in a specific geometric configuration. The shaped charges 1300 are positioned so that the majority of the energy released by the charges 1300 is directed through a charge cover sleeve 1500 towards the outer surface 1520 of the tubular element 1220, the released energy severing the tubular element 1220, as will be shown in due course.

Figure 34:
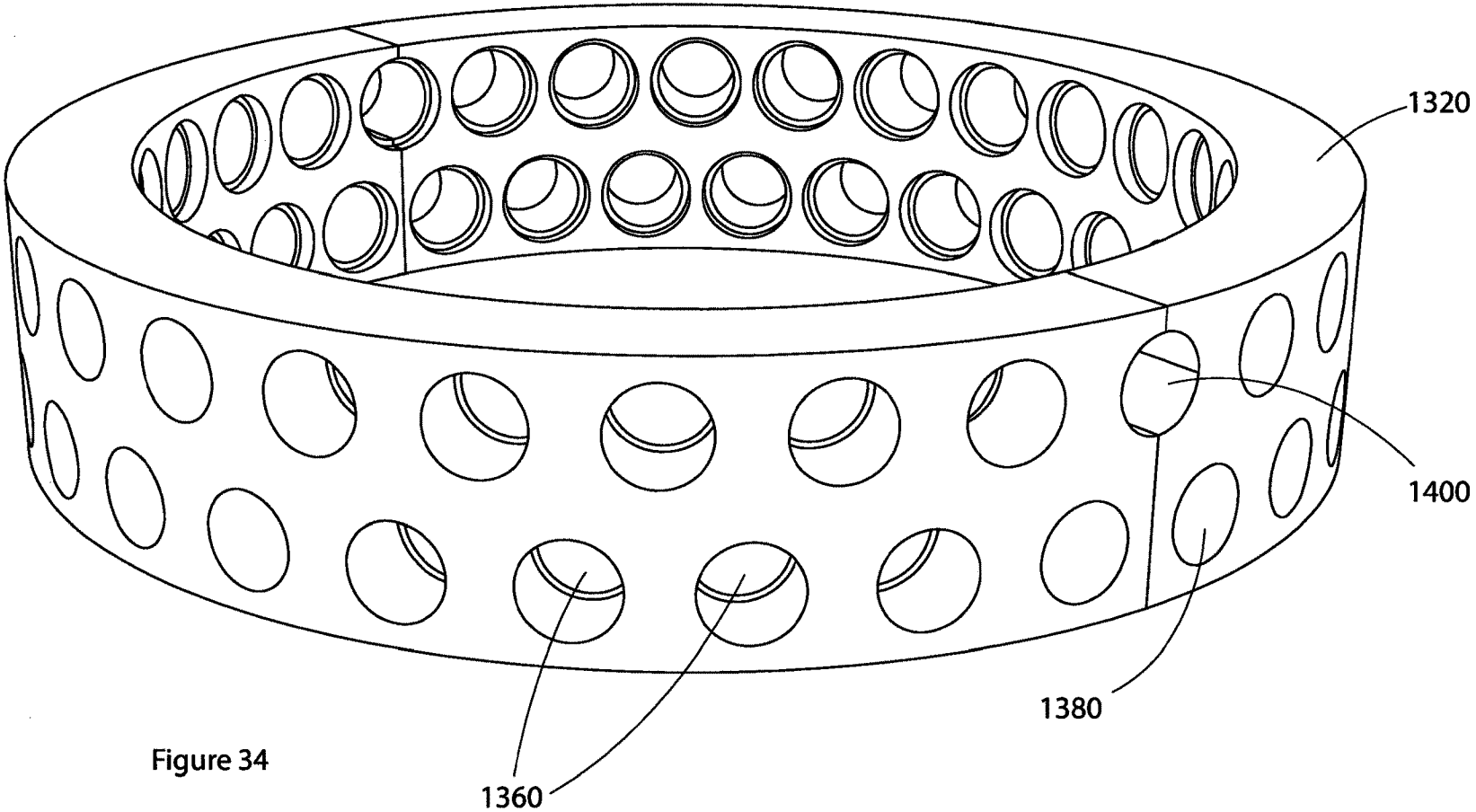
FIG. 34 is a schematic diagram of the charge carrier used in the well emergency separation tool of FIG. 32.

Referring to FIG. 34, a schematic diagram of the charge carrier 1320 used in the well emergency separation tool of FIG. 32, the charge carrier 1320 has a plurality of openings 1360 for the placement of the shaped charges 1300. As can be seen most clearly from this figure, the openings 1360 for the shaped charges 1300 are in two parallel rows 1380, 1400. The charge carrier 1320 is designed such that energy released during detonation of the charges 1300 which does not initially travel in the direction of the tubular element 1220, is reflected by the charge carrier 1320 such that the released energy does travel in the direction of the tubular element 1220 thereby maximising the effectiveness of the released energy in severing the tubular element 1220.

Referring back to FIG. 33, the charge carrier 1320 and the shaped charges 1300 are mounted in a containment housing 1260, designed and constructed to be able to withstand the explosion of the shaped charges 1300 in the well emergency separation tool 1000. This construction maintains the integrity of the system and prevents flow from exiting the riser 1020. The containment housing 1260 defines a substantially vertical bore 1420 extending from the riser 1020 to the flex joint 1100 (as shown on FIG. 1). The outer surface of the containment housing 1260 is fluidly isolated from sea 1060 by a tool body 1270.

Figure 35:
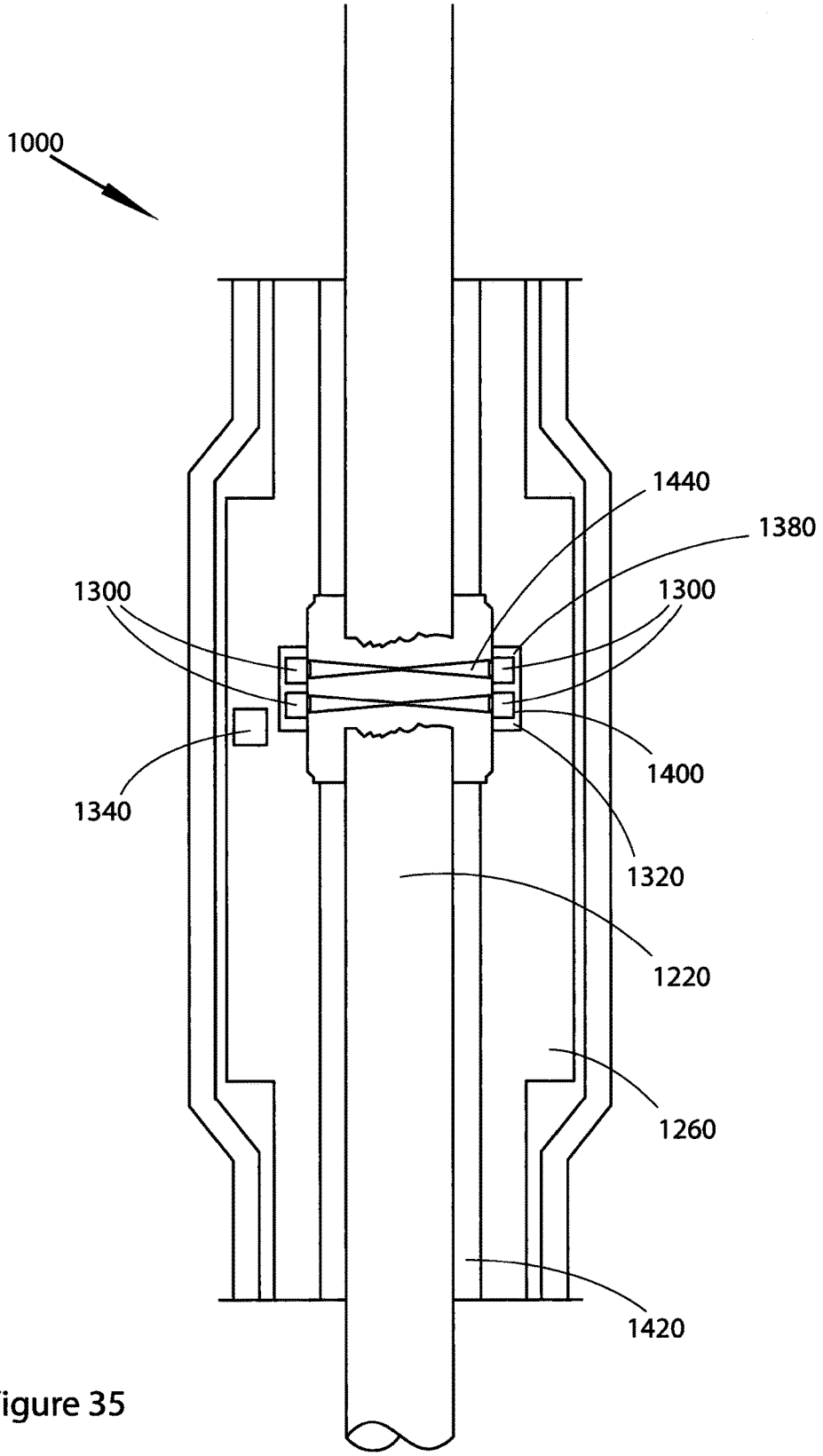
FIG. 35 is a schematic diagram of the internal structure of the well emergency separation tool of FIG. 32 after detonation of the shaped charges.

Referring to FIG. 35, a schematic diagram of the internal structure of the well emergency separation tool 1000 of FIG. 32 after detonation of the shaped charges 1300, it can be seen that upon detonation, each shaped charge 1300 releases energy in the form of a high velocity jet of metallic material 1440. The jets of metallic material 1440 are fired perpendicularly at the surface of the tubular element 1220, each jet of material 1440 combining with other jets of material 1440 in each of the respective rows 1380, 1400 to form two explosive impacts with the tubular 1220.

Figure 36:
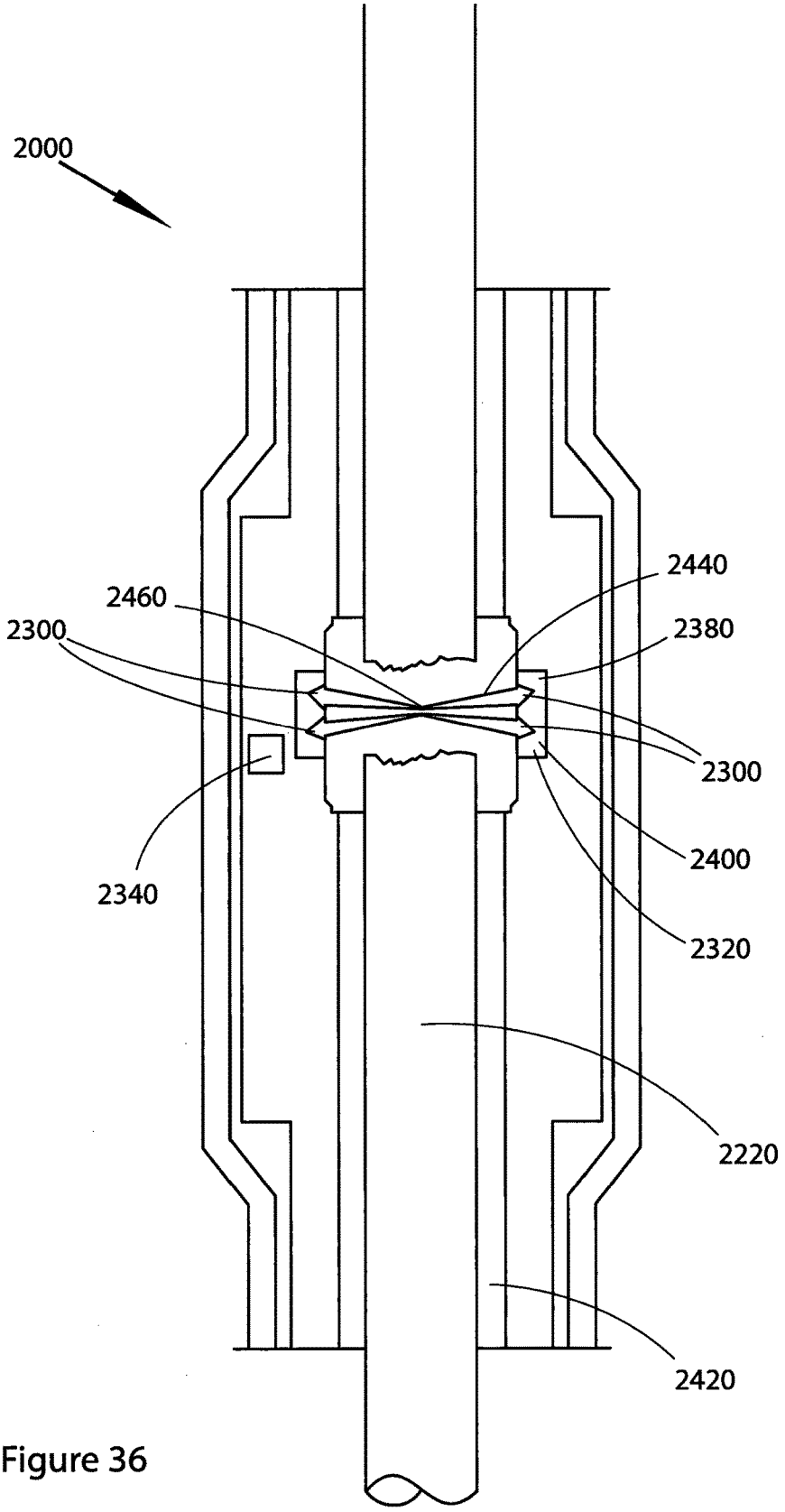
FIG. 36 is a schematic diagram of the internal structure of well separation tool after detonation of a plurality of shaped charges, according to an eighth embodiment of the present invention.

Referring to FIG. 36, a schematic diagram of the internal structure of well separation tool 2000 after detonation of a plurality of shaped charges 2300, according to a eighth embodiment of the present invention, it can be seen from this figure that the shaped charges 2300 are positioned differently in a charge carrier 2320 of this embodiment such that jets of metallic material 2440 released on detonation of the shaped charges 2300 directed to a central point 2460 in the centre of a well separation tool through bore 2420. Such an arrangement allows for the energy released by detonation to be focused on a smaller region of a tubular element 2220 with a potential enhanced cutting effect.

Figure 37:
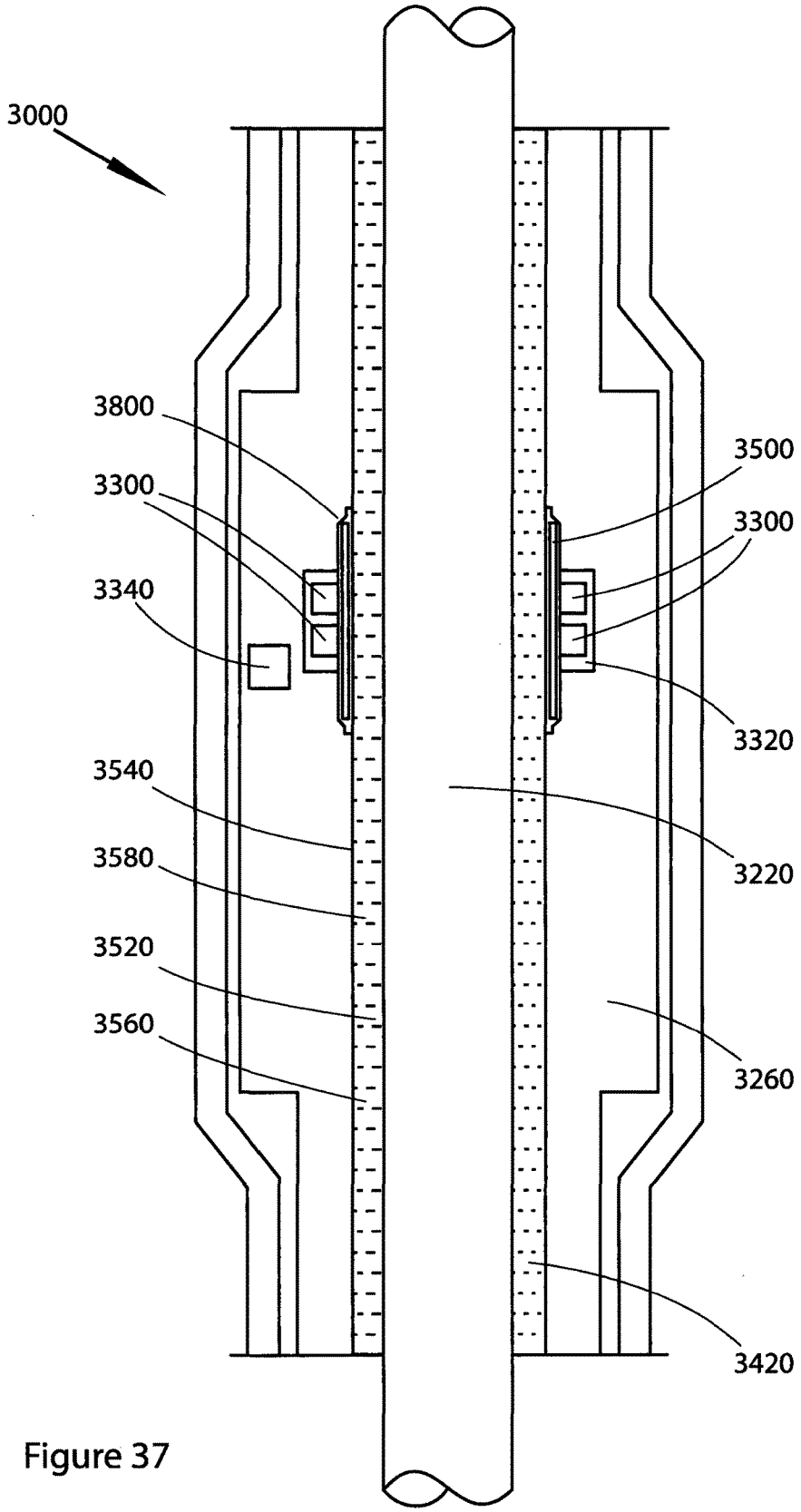
FIG. 37 is a schematic diagram of the internal structure of a well separation tool according to a ninth embodiment of the present invention.
Figure 38:
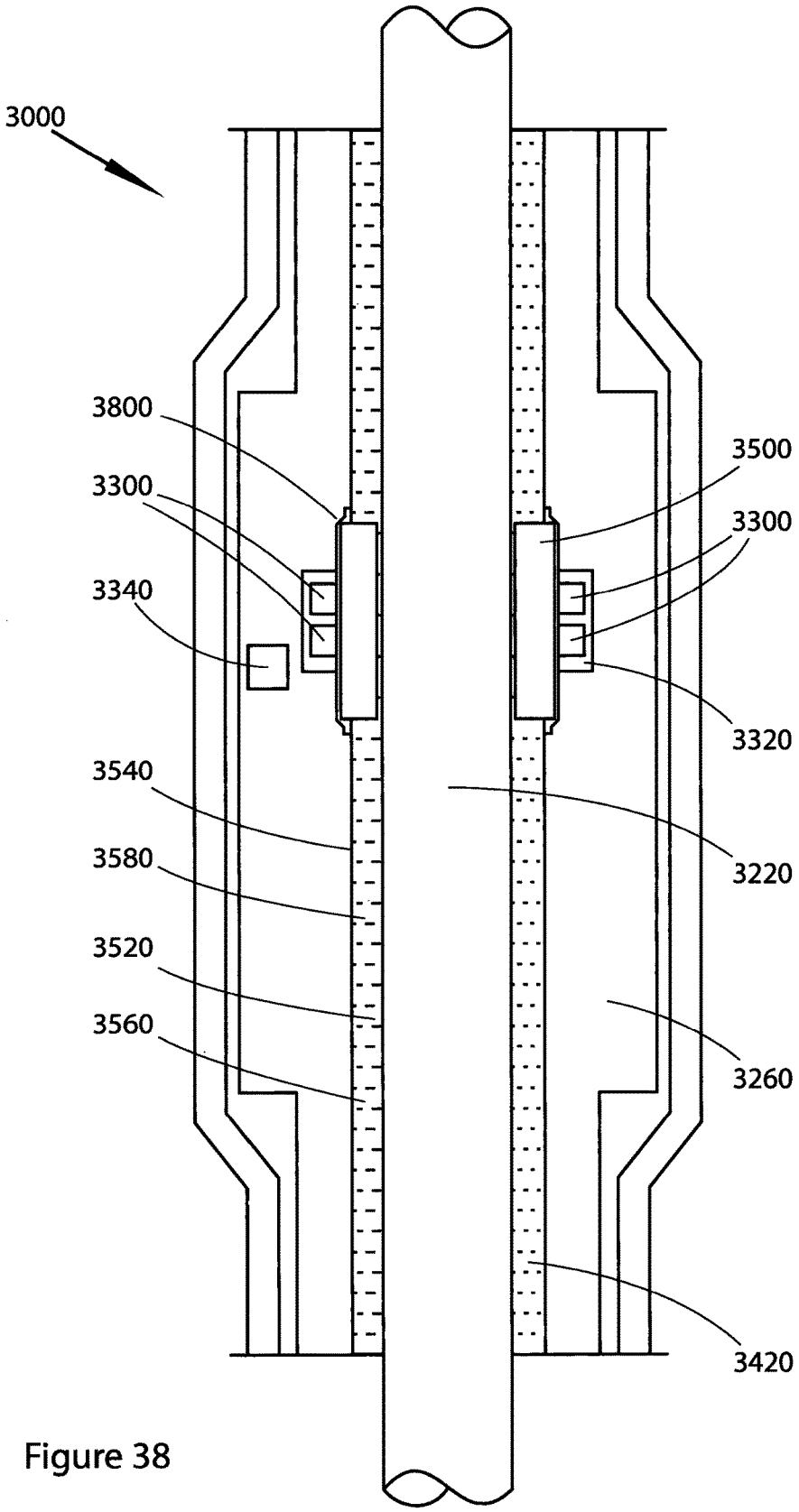
FIG. 38 is a schematic diagram of the internal structure of the well separation tool of FIG. 37 after inflation of the air bladder.

Reference is now made to FIG. 37, a schematic diagram of the internal structure of a well separation tool 3000 according to a ninth embodiment of the present invention. The well separation tool 3000 of this embodiment is similar to the well separation tools 1000, 2000 of the seventh and eighth embodiment with the essential difference that the well separation tool 3000 includes an air bladder 3500 housed in a charge cover sleeve 3800. In this embodiment, the annulus 3580 between the outer surface 3520 of the tubular element 3220 and the internal surface 3540 of the well separation tool 3000 is filled with a dense liquid 3560. On detonation of the charges 3300, the dense liquid 3560 will absorb some of the energy released by the detonation of the charges 3300, reducing the cutting effect of the high velocity jet of material. As shown in FIG. 38, a schematic diagram of the internal structure of the well separation tool 3000 of FIG. 37 after inflation of the air bladder 3500, the air bladder 3500 is inflated immediately prior to the detonation of the charges 3300 to displace the dense liquid 3560 from the annulus immediately surrounding the shaped charges 3300 to provide a less energy absorbing medium (air) through which the energy released by detonation of the shaped charges 3300 can travel.

Various modifications and improvements may be made to the above described embodiments without departing form the scope of the invention. For example, it may be desired to have multiple well emergency separation tools 1000 installed between the riser 1020 and the BOP stack 1120. A second well emergency separation tool 1000 may be included for redundancy. Alternatively, additional well emergency separation tools 1000 may be included if various sizes or types of workstring 1220 will be utilized. It may be desirable to install several sets of well emergency separation tools 1000 to increase flexibility of design. The well emergency separation tool 1000 may be installed when drilling operations commence and left on the BOP stack until all completion and workover activities are finished. Alternatively, the well emergency separation tool 1000 may be left on the well indefinitely and may be removed only when the well is decommissioned or when certain portions of well emergency separation tool 1000 need to be repaired or replaced. The well emergency separation tool 1000 is independent of traditional BOP stacks 1120.

The charge carrier 1320 is shown as having two rows of shaped charges. In other embodiments, the charges can be arranged in three or more rows of openings as necessary to provide a sufficient release of energy upon detonation to separate a tubular element.

The invention claimed is:

1. A severance tool for severing a target, the severance tool comprising:

a housing;

a plurality of focused energetics mounted in the housing; and a trigger mechanism adapted to detonate the plurality of focused energetics, wherein the plurality of focused energetics are aligned such that, on impact with a target comprising a material, the energy released by one of the plurality of focused energetics cooperates with the energy released by another one of the plurality of focused energetics to establish a separating force within the target material, wherein the target is a tubular element, the energy released by each of the plurality of focused energetics is directed at a tangent to an internal surface of the target at different locations around the target, and each of the plurality of focused energetics is aligned such that the energy released upon detonation is directed at a trajectory such that the energy is dissipated at or adjacent to the internal surface of the target at the different locations.

2. A severance tool according to claim 1 wherein each of the plurality of focused energetics is adapted to displace the target material, in use, on impact with the target.

3. A severance tool according to claim 1 wherein, upon detonation, the energy released by each of the plurality of focused energetics is in the form of a shockwave.

4. A severance tool according to claim 1 wherein the energy released by each of the plurality of focused energetics is in the form of a propelled object.

5. A severance tool according to claim 1 wherein at least some of the plurality of focused energetics are shaped charges.

6. A severance tool according to claim 5 wherein the shaped charges are linear shaped charges.

7. A severance tool according to claim 5 wherein the shaped charges are perforating charges.

8. A severance tool according to claim 5 wherein each shaped charge comprises an explosive material and a charge liner.

9. A severance tool according to claim 8 wherein the charge liner is a metal.

10. A severance tool according to claim 1 wherein the energy released by each of the plurality of focused energetics is adapted to engage the target at a target location.

11. A severance tool according to claim 1 wherein the energy released by at least one of the plurality of focused energetics is adapted to engage the target at a different target location to at least one other of the plurality of focused energetics.

12. A severance tool according to claim 1 wherein a first one of the plurality of focused energetics is, in use, aligned such that the energy released by the first one of the plurality of focused energetics engages the target at a first target location and a second one of the plurality of focused energetics is, in use, aligned such that the energy released by the second one of the plurality of focused energetics engages the target at a second target location.

13. A severance tool according to claim 12 wherein the first target location is spaced away from the second target location.

14. A severance tool according to claim 1 wherein the energy released by the plurality of focused energetics creates a rotational force within the target.

15. The severance tool according to claim 1 wherein the plurality of focused energetics are arranged in a charge holder in a tiered array comprising a first tier and a second tier and wherein the energy released by the plurality of focused energetics in the first tier creates a rotational force within the target and the energy released by the plurality of focused energetics in the second tier creates another rotational force within the target in an opposite direction of the rotational force created by the energy released by the plurality of focused energetics in the first tier.

* * * * *